US011866240B2

(12) United States Patent
Wötzer

(10) Patent No.: US 11,866,240 B2
(45) Date of Patent: Jan. 9, 2024

(54) CHILD-RESISTANT PACKAGING

(71) Applicant: IDEEWISS AG, Hünenberg (CH)

(72) Inventor: Philipp Wötzer, Rotkreuz (CH)

(73) Assignee: IDEEWISS AG, Hünenberg (CH)

( * ) Notice: Subject to any disclaimer, the term of this patent is extended or adjusted under 35 U.S.C. 154(b) by 22 days.

(21) Appl. No.: 17/430,472

(22) PCT Filed: Feb. 12, 2020

(86) PCT No.: PCT/EP2020/053624
§ 371 (c)(1),
(2) Date: Aug. 12, 2021

(87) PCT Pub. No.: WO2020/165267
PCT Pub. Date: Aug. 20, 2020

(65) Prior Publication Data

US 2022/0127054 A1 Apr. 28, 2022

(30) Foreign Application Priority Data

Feb. 13, 2019 (EP) ..... 19156838

(51) Int. Cl.
*B65D 75/32* (2006.01)
*B65D 50/02* (2006.01)

(52) U.S. Cl.
CPC ..... *B65D 75/325* (2013.01); *B65D 50/02* (2013.01); *B65D 2215/02* (2013.01)

(58) Field of Classification Search
CPC .. B65D 75/325; B65D 50/02; B65D 2215/02; B65D 75/367; B65D 75/327
(Continued)

(56) References Cited

U.S. PATENT DOCUMENTS 4,664,262 A * 5/1987 White ..... A61J 1/035 206/532
5,046,618 A 9/1991 Wood
(Continued)

FOREIGN PATENT DOCUMENTS

CA 2802113 A1 12/2011
EP 2896580 A1 7/2015
(Continued)

OTHER PUBLICATIONS

Office Action dated Jul. 4, 2022,for Dominican Republic Application No. P2021-0168.
(Continued)

*Primary Examiner* — Chun Hoi Cheung
(74) *Attorney, Agent, or Firm* — Eversheds Sutherland (US) LLP

(57) ABSTRACT

Child-resistant packaging (1), which comprises at least one blister card (10), known per se, with a carrier film (20) and a cover film (30), wherein the carrier film (20) forms, with at least one blister cavity (25) for receiving a packing product (40), a top side (11) of the blister card (10), and the cover film (30) is connected extensively to the carrier film (20), closes the blister cavity (25) filled with the packing product (40), and forms an underside (12), located opposite the top side (11), of the blister card (10). At least one backing card (50) is fastened in a movable manner at two opposite side edges (15, 16) or peripheral portions (17, 18) of the blister card (10), said backing card (50) resting in a planar manner against the underside (12) of the blister card (10) in a securing position (70) and in the process securing the enclosed packing product (40) against unintentional removal, wherein the backing card (50) is transferable reversibly from the securing position (70) into a removal position (80) by means of external force application (90) by mirror-inverted compression (91, 92) of two mutually oppo-
(Continued)

site packaging portions (5, 6), wherein, during the external force application (90), the backing card (50) is spaced apart from the underside (12) of the blister card (10), forming a packaging interior (100), and the packing product (40) can be released into and removed from the packaging interior (100) by pushing through (35) the cover film (30).

20 Claims, 10 Drawing Sheets

(58) Field of Classification Search
USPC ..... 220/260, 528–540; 206/528–540, 206/531–534.2
See application file for complete search history.

(56) References Cited

U.S. PATENT DOCUMENTS 6,540,081 B2 * 4/2003 Balz ..... B65D 83/0463 206/538
7,000,769 B2 * 2/2006 Killinger ..... B65D 75/327 206/828
7,201,274 B2 * 4/2007 Paliotta ..... B65D 83/0463 206/538
7,431,160 B2 * 10/2008 Drought ..... A61J 1/035 221/88
8,746,454 B2 * 6/2014 Doucet ..... B65D 83/0463 206/538
8,875,891 B2 * 11/2014 Yamashita ..... B65D 75/327 206/532
2001/0017273 A1 * 8/2001 Raj ..... B65D 75/327 206/532
2002/0070146 A1 * 6/2002 Freeze ..... B65D 5/422 206/768
2011/0042262 A1 * 2/2011 Naik ..... B65D 83/0463 206/459.1
2011/0132795 A1 * 6/2011 Silverman ..... B65D 83/0463 206/539
2011/0168732 A1 * 7/2011 Antunes ..... B65D 83/0463 221/69
2011/0214277 A1 9/2011 Yamashita et al.

FOREIGN PATENT DOCUMENTS

GB 2541070 A 2/2017
JP 201494757 A 5/2014
WO 2004041675 A1 5/2004
WO 2004085266 A2 10/2004
WO 2014189971 A1 11/2014

OTHER PUBLICATIONS

International Search Report for PCT/EP2020/053624, dated Apr. 28, 2020 (14 pages).
Search Report for European Patent Application No. 19156838.5 dated Jun. 4, 2019 (7 pages).
Office Action for Dominican Patent Application No. P2021-0168, dated Jul. 7, 2023 (15 Pages).

* cited by examiner

CHILD-RESISTANT PACKAGING

The invention relates to a child-resistant packaging, in particular a medicinal product packaging, comprising at least one blister card, wherein the blister card comprises two films, of which one film is configured as a carrier film with at least one blister cavity for receiving packing product, in particular for receiving a pharmaceutical active substance formulation such as a tablet and forms a top side of the blister card, and the other film is configured as a push-through cover film, wherein the cover film at least in sections is connected extensively to the carrier film leaving open the at least one blister cavity, and at least in sections forms an underside of the blister card opposite the top side and the cover film closes the at least one blister cavity filled with packing product.

Many varied embodiments of packagings which are considered to be child-resistant and/or senior-friendly are already known from the prior art.

According to DIN EN 14375 in the current version of September 2016, in Europe non-reclosable packagings for pharmaceutical products are considered to be "child-resistant" if at least 85% of a test group of infants aged from 42 to 51 months are not able to gain access to more than eight of at least ten presented dose units, i.e. for example, tablets, capsules or dragées within ten minutes. The packing is considered to be senior-friendly if at least 90% of a test group of adults gains access to at least one of the dose units in the one-minute test.

The relevant provisions in the USA, which are specified there in the "Poisons Prevention Packaging Act" (PPPA) are however comparatively substantially stricter. There children must not create any access to a dose which can cause serious damage in a "child-resistant" packaging. In extreme cases, this can already be possible by removing only one tablet or one dose unit.

For example, DE 20 2004 003 781 U1 discloses a child-resistant rectangular packaging comprising two interconnected films, wherein an extensive closure area encloses a receiving space for filling material. For opening and removing the filling material, for example, a tablet, the receiving space is opened along a marked weakening line or by removing an edge portion of the films.

Likewise DE 10 2004 062 864 A1 discloses a film container with two interconnected films as well as with receiving chambers for a filling material, wherein at least one of the films is provided with markings for tearing open the films. The marking is exposed after a bending of the films whereupon the filling material can be removed from the film container by tearing open the films.

A disadvantage of these known designs of tear-open packagings is at least that the manufacture of films with tear-open sections which are usually designed as metal films is expensive. Furthermore, with such tear-open packagings it cannot be eliminated that infants can also remove several dose units at the same time which is why such tear-open packagings are not considered to be "child-resistant" at least in the USA.

In addition so-called wallet packagings are already known from the prior art. Thus, for example, the documents DE 20 2006 007 553 U1, DE 44 29 503 C2 and EP 2 055 649 A1 disclose packagings in which blister packs as blister strips or blister cards serve as primary packaging for the packing material and these are interconnected with a secondary packaging, for example, made of folded card. For child-proof protection, for example, tablets as packing material are in this case therefore located in a manner known per se in cavities of a blister strip or a blister card heat-sealed inside a folded box or a folded carton. For this purpose the blister cards can, for example, be adhesively bonded, sealed, riveted or fixed with labels onto the outer secondary packaging or alternatively inserted removably in cartons of the secondary packaging. For child proofing, depending on the design, the outer secondary packagings, mostly in the form of folded boxes, are designed so that access to the internal blister cards is made difficult.

The document GB 2 352 231 A also discloses a wallet packaging in which the entire blister card filled with tablets can be removed from the secondary packaging. For this purpose the blister card is removed from a lateral slot of the secondary packaging.

Even with such wallet packagings it is not excluded that infants can also remove several dose units from the internal blister cards after opening the outer folded box packaging. In addition, the manufacture of such multilayer packagings with different packaging materials is expensive.

Blister packs for medicinal products such as tablets, capsules and dragées have been known for a long time and must be visually attractive and application-safe. The term blister pack is usually understood as a visible packaging, i.e. a product packaging which allows the customer or purchaser to see the packed goods.

Blister packs are widely used for the packaging of pharmaceutical active substance formulations such as, for example, tablets. Such packagings are also called push-through pack and are usually produced in strip- or card form. A blister card or a blister strip usually comprises two films, of which one carrier film is usually made of transparent plastic.

Individual indentations, so-called blister cavities are formed in the carrier film into which the packing product, mostly individual dose units of tablets, capsules or dragées are inserted and which are sealed with a cover film, for example, made of aluminium. For example, deep-drawn plastic trays with an aluminium cover film sealed on the back are used for packaging tablets.

Such blister packs offer several advantages over glass or plastic bottles. They are more hygienic, depending on the film materials used, undesirable influences such as high air humidity or dirt can be eliminated with such blister packs and it is also easier to identify the remaining number of dose units in the packaging. Special blisters also allow the dose schedule to be depicted on the packaging. For example, the packaging of many contraceptive pills is printed with days of the week. By this means it is not only possible to monitor what has been taken but different tablets can also be reliably assigned to the days of the menstrual cycle.

In addition to the primary task of packaging, blister packs which are "child-resistant" must also be designed to be senior-friendly however, wherein the requirements of these two groups of users are contrary to one another. This is because child-resistant packagings for protecting infants on the other hand present an insurmountable obstacle for seniors.

For example, so-called "peel-push blisters" are used in which blister packs are additionally provided with removable (peelable) safety films in a "child-resistant" manner. In this case, firstly the removable films must be removed from the cover films as push-through protection before the corresponding dose can be pushed from the packaging through the cover film. However it is frequently difficult for older people to be able to grip and remove such removable safety films.

Furthermore, in hitherto known blister packs it is frequently a disadvantage that blind people cannot distinguish by means of the blister card which medicament is involved. However, this problem not only arises for blind or visually impaired people. In most cases, on a blister card the product and company name of the medicinal product is printed on the sealing layer, i.e. on the cover film which is usually an aluminium film. As soon as several dose units have been removed from the blister card by pushing through the cover film, in most cases the imprint with the name of the medicinal product can no longer be identified or only identified with difficulty, with the result that the risk of undesired confusions is increased.

A further disadvantage of conventional blister packs is that the dose units are usually pushed out from the blister pack by pushing through into the hand of the patient or onto a base such as, for example, a table top. In this case however, one or more dose units removed, for example, tablets, can undesirably fall to the floor which is particularly problematical for older persons. In addition, removal by hand is mostly not possible in a hygienic manner. This is particularly the case for persons who have to take tablets at specific time intervals even during their work time and cannot wash their hands for this in each case. As an example, mention is made here of building workers or craftsmen who must possibly remove and grasp tablets from a conventional medicinal product packaging with contaminated hands.

It is therefore the object of the present invention to provide child-resistant packaging, in particular a child-resistant medicinal product packaging which at the same time is also senior-friendly and avoids the described disadvantages of the prior art.

This object is achieved in a child-resistant packaging according to the preamble of claim 1 with the features of the characterizing part of claim 1. The dependent claims relate to further advantageous embodiments of the invention.

In a child-resistant packaging according to the invention, in particular in a medicinal product packaging according to the invention, comprising at least one blister card, wherein the blister card comprises two films, of which one film is configured as a carrier film with at least one blister cavity for receiving packing product, in particular for receiving a pharmaceutical active substance formulation such as a tablet and forms a top side of the blister card, and the other film is configured as a push-through cover film, wherein the cover film at least in sections is connected extensively to the carrier film leaving open the at least one blister cavity, and at least in sections forms an underside of the blister card opposite the top side and the cover film closes the at least one blister cavity filled with packing product, at least one backing card is fastened in a movable manner at two opposite side edges or at two opposite peripheral portions of the blister card and this backing card in a securing position is configured to rest at least in sections in a planar manner on the underside of the blister card and in so doing to secure the enclosed packing product against unintentional removal and against pushing through of the cover film, wherein the backing card can be transferred reversibly from the securing position into a removal position by means of an external force application by mirror-inverted compression of two mutually opposite and spaced apart packaging portions, wherein during the removal position fixed by external application of force, the at least one backing card is spaced apart from the underside of the blister card forming a packaging interior having at least one packing product removal opening wherein in the removal position the packing product can be released by pushing through the cover film into the packaging interior and removed from the packaging interior through the at least one packing product removal opening.

The carrier film of the blister card has one or more fold edges and/or perforations as weakening lines in order to be able to be folded, folded or curved along these defined edges or weakening lines. It is thereby ensured that largely independently of the choice of material of the packaging, the movement transition between the securing position in which no external application of force is made to the spaced apart packaging portions and the removal position fixed during an external application of force is a reversible to-and-fro movement. Depending on the arrangement, one or more fold edges in the carrier film of the blister card can also ensure that the packaging has a sufficient stability or buckling resistance as a result of the fold edges.

It is advantageous with such a packaging that for children, access to the packing product, in particular to a packed pharmaceutical active substance formulation, is blocked since the packaging is designed so that infants cannot embrace with one hand the mutually opposite packaging portions which must be compressed in a mirror-inverted manner with one hand to transfer the packaging from the securing position into the removal position. To this end, the two mutually opposite packaging portions which must be compressed are advantageously to far from one another for an infant to be able to accomplish this with one hand. The packaging is designed so that it is only sufficiently stiff in the removal position fixed by mirror-symmetric compression during the application of an external force so that in this removal position the packing product or a tablet can be removed from a blister cavity by pushing through the cover film of the blister card. Thus, in any case a simultaneous two-handed actuation of the packaging is required. The packaging must be brought into the removal position by compression and fixed therein in order that at the same time, one or more packing product units can be pushed through into the packaging interior from the corresponding blister cavities with the other free hand.

Therefore two hand grips must be executed simultaneously which is almost impossible for infants in the test age from 42 to 51 months specified according to DIN EN 14375 as a result of their motor capabilities and the size of their child hands. By suitably selecting the distances between the pressure points on the opposite packaging portions which must be compressed with one hand for reversible fixing of the removal position in order to be able to push through the packing product from the blister card simultaneously with the second hand, depending on the individual requirement, certain age groups of infants can be reliably deterred from any possible access to the packaging content or to the packing product. In the design of the packaging according to the invention, care must therefore be taken to ensure that the distances between the pressure points on the opposing packaging portions in order to compress these are sufficiently far from one another so that children's hands cannot compress these with one hand.

Particularly flexibly by means of a suitable choice of these dimensions, i.e. the distances between the pressure points on the opposite packaging portions of the packaging according to the invention and by means of a suitable selection of blister cover films known per se by means of which the push-through force for pushing through or for removal of the packing product can be varied, the packaging according to the invention can also be adapted particularly flexibly to safety conditions valid in each case. Thus, for example, it is possible for a child-resistant packaging to design the packaging according to the invention according to the current requirements of the PPPA in the USA so that infants cannot open this packaging using only their hands without the assistance of external tool. At the same time however, in tests with prototypes of the packaging according to the invention it has been shown that seniors in care homes as subjects had no problems with gripping the packaging with one hand and compressing it so that this was fixed in its removal position and the seniors could remove individual tablets from the blister cards of the packaging in a manner known per se using the other hand. Subsequently the term a blister card selected here should also be understood as synonymous with the likewise usual designation of a blister strip as blister pack for individual packing product units such as, for example, tablets.

Depending on the choice of material and layer structure of the blister cover films, it is possible for example to vary the push-through force for pushing through or for removing the packing product in a range between about 20 N and 120 N. These push-through forces were determined in tests with a so-called pharma pin having a diameter of 10.5 mm. Depending on the product to be packaged or depending on the potential hazard of the pharmaceutical active substances in the packing product, at least two parameters are thus available for the particularly flexible and individual design of a safety-confirming packaging according to the invention.

All the materials known from the prior art can be used as blister films. The carrier film and the cover film can be constructed of one or of several layers. The cover film is connected to the carrier film, for example, by adhesive bonding, heat-sealing or sealing. For example, plastics such as polyamide (PA), polyester (UP), polycarbonate (PC), polypropylene (PP), polyethylene (PE), polyvinylchloride (PVC) or corresponding copolymers can be used as typical materials for the carrier film. For example, composite materials such as one or more plastic films with paper or cardboard layers can be used as carrier film. For example, metal films such as aluminium films or aluminium composite films produced from aluminium and a plastic, for example, can be used as cover film. Likewise composite films vapour-coated with aluminium or laminated paper films can be used as cover films.

The at least one backing card which rests on the underside of the at least one or the plurality of blister cards filled with packing product as child-resistant removal protection in the securing position of the packaging can optionally be constructed of one or several layers. Expediently the backing card can be constructed of the same materials from which the at least one blister card is produced. It is also possible within the scope of the invention that the backing card is made from a different material than the materials used to construct the blister cards.

In a simple embodiment, a single-layer or single-ply reinforcement layer for example made of a transparent plastic with appropriate stiffness can be used as backing card. Within the scope of the invention, the backing card can also be configured as a multilayer reinforcing plate.

In a further preferred embodiment the backing card can also be a further blister card which is arranged in a mirror-inverted manner with respect to the first blister card and is fastened movably to the blister card and in which the push-through cover films are in each case oriented facing one another towards an interior packaging interior. Thus, robust carrier films which protect the packing product towards the outside are arranged on the outside of the packaging on the outer surfaces thereof.

Within the scope of the invention, depending on the design of the packaging the concept of a backing card should thus be understood as an extensive reinforcement layer or reinforcement plate approximately the same size as one or more blister cards which can have a single-ply or multiply structure. A backing card can, for example, be formed from a carrier film which is also provided with the blister card or can optionally also be a blister card with the corresponding blister cavities for receiving packing product.

The backing card serves as a backing means or as protective means for protecting the cover film of the blister card and should prevent the cover film of the blister card being pushed through or damaged in the securing position of the packaging. The backing card thus acts as a cover card for covering or for protection for the opposite cover film on the underside of the associated blister card. In contrast to the previously mentioned known removable (peelable) security films which are adhesively bonded for protection of cover films directly to these and which must be removed from these cover films again, the backing card however forms its own portion of the packaging separate from the cover film of the opposite blister card associated therewith to be protected. In the securing position for protection of the cover film arranged opposite the backing card certainly rests on this but does not adhere to this. The backing card can be moved, shifted, pivoted, folded and/or swivelled into a position spaced apart from the cover film by appropriate compression in the removal position of the packaging, depending on the design of the packaging. Advantageously no pulling or release of the backing card from the cover film is required for this. The interior packaging space which is enclosed by the one or the plurality of blister cards as well as by one or by a plurality of backing cards affords the advantage that packing product such as a tablet, for example, which in the fixed removal position was pushed out of the corresponding blister cavity by pushing through the cover film initially enters into the packaging interior of the packaging and can be removed from the packaging interior through a removal opening.

It is thus advantageously avoided that a tablet must be pressed from a conventional blister pack onto an external base such as a table and can be lost in so doing. Furthermore, by appropriate design of the packing product removal opening, this can be configured to that, for example, a tablet can be poured directly from the packaging interior into the mouth of the patient without this needing to be grasped by hand for this purpose.

According to the invention, the backing card can be reversibly transferred from the securing position into a removal position by means of application of an external force by mirror-inverted compression of two mutually opposite and spaced apart packaging portions. By this it should be understood that the packaging is designed so that at least one backing card by itself alone or however in combination with at least one corresponding blister card or with further backing cards can be transferred from the securing position into the removal position by compression by means of one hand of the user who would like to open the packaging. This movement should be understood as reversible as a to-and-fro movement between the securing position—without external application of force on the spaced-apart packaging portions—and the removal position,—during the application of external force on the spaced-apart packaging portions. The corresponding two mutually opposite and spaced-apart packaging portions can be marked in colour for example according to the design and application of the packaging and/or can have a structural or haptic design such as, for example, an embossing, fluting or pimpling.

Depending on the embodiment and design of the packaging, it can be necessary that after pushing through a dose unit of the packing product into the packaging interior, wherein the packaging is fixed in its removal position by compressing, the packaging must then be gripped again to empty the packaging interior. This can be the case, for example, when side tabs on the narrow sides must be compressed to transfer the packaging from its securing position into its removal position. For emptying the packaging interior, it can however then be provided that on a narrow side the side tabs must be opened which can make it necessary to grip the packaging again. This further additional handling step can further improve the manipulation security of the packaging against unintentional actuation by infants.

As a result of the movable fastening of the at least one backing card on two opposite side edges or on two opposite peripheral portions of the blister card, these packaging portions are movably coupled to one another.

The packaging according to the invention is in no way limited to the accommodation of packing product with pharmaceutical active substances, i.e. to medicinal product packaging. Likewise arbitrary units of packing product can be stored in a packaging according to the invention, which, for example, are so small that as a result of their size they are hazardous for infants and can be swallowed by infants. Merely as an example for this, in addition to food supplement preparations, chewing gums or chewing dragées such as nicotine chewing gums, mention is made of small electronic components, replacement parts, tool inserts, disposable metering instruments, disposable needles and the like which can also be stored securely in packagings according to the invention. Thus, it can be advantageous if, for example, replacement parts for E cigarettes or for LED lights which are very small and can be swallowed by infants, are stored in a packaging according to the invention in a child-resistant manner.

Subsequently in the description the assignment of specific terms with regard to a location, a position or an orientation such as, for example, "horizontal", "vertical", "in the horizontal direction", "in the vertical direction", "above", "below", "inside", "outside", "front", "thereunder", "thereover" etc. is merely selected for simplification and these details possibly relate to the representation in the drawings but not necessarily to a usage or storage position of the packaging according to the invention. In order to clarify that in the intended use of the packagings according to the invention, the cover films of the blister cards to be protected are each oriented inwards towards the packaging interior, the undersides of the blister cards covered with the cover films at least in sections each correspond to the inner sides of the blister cards in relation to the packaging interior of the packaging.

It can be particularly expedient if in a packaging according to the invention, the at least one backing card comprises a carrier film or is formed from a carrier film.

As already mentioned previously, the backing card serves in each case as mechanical protection of the blister card in order to protect the packing product or the tablets from unintentional removal as a result of pushing through the cover film. For this purpose, in a particularly simple and cost-effective embodiment of the invention at least one backing card made of a carrier film or comprising a carrier film can be fastened movably to the blister card. In a securing position this backing card comprising a carrier film is configured to rest in a planar manner on the underside of the blister card at least in sections and thereby secure the enclosed packing product against an unintentional removal and against pushing through the cover film.

Particularly advantageously in a packaging according to the invention, the at least one blister card as well as the at least one backing card can each be configured in the form of rectangles, wherein the backing card is fastened in each case on two opposite side edges or on two opposite peripheral portions of the long sides of the blister card.

In this variant of the invention the blister cavities for receiving packing product units can be arranged accordingly in rows or in matrix fashion according to the size of the rectangular blister card. The at least one backing card is expediently also configured in rectangular form and has substantially the same dimensions as the corresponding blister card the protection of which the backing card is provided. The two cards are fastened movably against one another along their opposite long sides. Depending on the embodiment, the two cards can be fastened to one another directly on their long side edges or along peripheral portions along their long side edges. Removal of packing product already pushed out from the blister cavities from the packaging interior between the blister card and the corresponding backing card is accomplished in the removal position of the packaging at its narrow sides.

In an advantageous further development of the invention, in a packaging the at least one backing card can be movably fastened by means of connecting tabs, preferably by means of a plurality of serially arranged connecting webs at two opposite peripheral portions of the blister card.

In this embodiment the packaging interior is delimited laterally by the movable connecting tabs or connecting webs. These connecting tabs or connecting webs are arranged so that they allow a reversible translation movement or relative movement in the longitudinal direction of the blister card and the corresponding backing card between the securing position and the removal position of the packaging.

Particularly advantageous in a packaging according to the invention at least one inscription tab can be fastened to the blister card and/or the backing card.

As a result of the at least one inscription tab on the packaging, the imprint, for example, the product and/or company name of the packing product or the medicinal product is clearly legible at any time. The inscription can, for example, also be accomplished in Braille script so that blind people or visually impaired people can directly identify on the packaging and independently of the degree of dose units or packing product units already removed which packed product or medicament it is. The inscription tab can be attached on one side or both sides of the packaging.

For example, details of the removal intervals of the packed dose units can be printed directly on one or more inscription tabs which are connected directly to the blister card and/or backing card.

It is also provided within the scope of the invention that one or more inscription tabs are provided to be printable or embossable in order to be able to design the packaging with individual information on removal intervals.

It can be advantageous if in a packaging according to the invention, the at least one inscription tab is fastened at a side edge or at a peripheral portion of the blister card and projects over the blister card.

In one embodiment the one or the plurality of inscription tabs is/are not only particularly easy to read but they can also be designed so that as a result of these inscription tabs the compression of the packaging, i.e. the transfer from the securing position into the removal position of the packaging is made difficult for child hands. This can be achieved, for example, by roughened and/or jagged portions on the outer edges of the inscription tabs which are unpleasant for infants to grasp with small children's hands and which consequently prevent compression precisely at these packaging portions.

A packaging according to the invention can be designed to be particularly application-safe if the side of the packaging interior opposite a packing product removal opening can be closed with a closure tab.

In this embodiment, the packing product or a tablet can be removed from the packaging interior exclusively through a packing product removal opening. An unintentional removal or falling out of the packing product from the packaging interior can thus be successfully prevented.

In a further advantageous embodiment of the packaging according to the invention, the at least one packing product removal opening of the packaging interior can be closed with a closure tab. In this version of the packaging the closure tab of the packing product removal opening must be additionally opened in order to remove the packing product already present in the packaging interior from the packaging with the result that the degree of retention of the packing product is further increased.

It can be particularly expedient in a packaging according to the invention if the at least one backing card is a further blister card with a carrier film with at least one blister cavity for receiving packing product, in particular for receiving a pharmaceutical active substance formulation such as a tablet, as well as a cover film, wherein the at least one further blister card is arranged so that its carrier film forms an outer surface of the packaging and its cover film is oriented towards the packaging interior.

This packaging design affords the advantage that at least one further blister card is used as backing card for protecting the at least one "first" blister card. Thus, two blister cards are arranged in a mirror-inverted manner with respect to one another and in the securing position mutually protect their cover films resting on one another from unintentional pushing out of the packing product from the blister cavities. This design is particularly economical since the further blister card in its function as backing card can be constructed of the same material or the same materials as the at least one "first" blister card. Depending on the configuration of the packaging according to the invention, it is possible that no preferable arrangement or position of the at least one "first" blister card and the one or plurality of further blister cards which serve as backing cards can be identified on the backing cards. In this preferred embodiment the interconnected blister cards can, for example, be configured identically and/or arranged symmetrically relative to a packaging axis and/or a packaging plane. Such a packaging in which two or more blister cards are provided offers a further advantage since the largest possible number of dose units of the packing product can be packed in the blister cards in a small packaging space.

Particularly expediently in a packaging according to the invention in the securing position, the blister cavities filled with packing product of two blister cards resting on one another can be arranged congruently above one another. In this embodiment, the blister cavities of two corresponding blister cards which in the securing position of the packaging rest with their cover films on one another lie congruently above one another. In this embodiment of the packaging, a particularly safe storage of the packing product can be achieved which is protected against unintentional pushing through of the cover films.

Alternatively to this, it can also be provided within the scope of the invention that in the securing position the blister cavities filled with packing product of two blister cards resting on one another can each be arranged offset with respect to one another. Also in this embodiment of the packaging, the packing product can be reliably protected against unintentional pushing through of the cover films.

In a particularly pleasing embodiment of the packaging according to the invention, the packaging can be configured to be cushion-shaped, wherein the two outer surfaces of the packaging are either formed by a first blister card and a further blister card with packing product filled in blister cavities or alternatively by one blister card and by an opposite backing card without packing product, which are interconnected at two opposite side edges of the blister card, wherein the side edges form the long sides of the packaging and mirror-inverted overlapping closure tabs are fastened on the mutually opposite narrow sides of the blister cards in each case.

The mirror-inverted overlapping closure tabs on the narrow sides of the packaging can advantageously serve as first and second mutually opposite and spaced apart packaging portions which must be compressed in a mirror-inverted manner for fixing the cushion-like packaging in its removal position. In the securing position the packaging is substantially flat and the two outer surfaces or outer sides lie with their inner sides on one another. As a result of compression on the narrow sides of the packagings this arches in a cushion shape and in the removal position forms a packaging interior which has an approximately oval cross-section. Expediently the closure tabs on the narrow sides of the packaging are trimmed accordingly in an oval rounded manner.

A further pleasing packaging variant according to the invention can be configured as a straight prism with an even number of outer surfaces, wherein the outer surfaces are formed by one or more blister cards with packing product filled in blister cavities or alternatively by at least one blister card and by one or more backing cards without packing product which are connected at their opposite side edges arranged next to one another and form the long sides of the packaging.

For example, four, six or eight blister cards or alternatively also backing cards without packing product can be combined in a strip-like manner as outer surfaces of a straight prism. The blister cards and/or backing cards are in this case connected at their long side edges with the respectively adjacent blister cards and/or backing cards. In order to increase the mobility of the blister cards and/or backing cards arranged next to one another in a strip-like manner, the long side edges thereof can be implemented as fold edges and/or have perforations for weakening the material of the carrier films.

Depending on the requirement for the packaging, individual, several or all the outer surfaces of the packaging prims can be configured as blister cards and have the same or different numbers of blister cavities. For example, in a hexagonal prism every other outer surface can be configured as a strip-shaped blister card with blister cavities wherein alternately the outer sides provided in each case between two blister cards are implemented as backing cards without blister cavities.

Particularly advantageously in a packaging according to the invention, a distance between mutually opposite packaging portions in the securing position can be greater than the distance between the same mutually opposite packaging portions in the removal position. As has already been noted, by suitable dimensioning of the packaging dimensions, it can be ensured that the distance between mutually opposite packaging portions in the securing position which must be compressed to transfer the packaging, for example, by moving, shifting, folding and/or pivoting into the removal position, is sufficiently large so that these two packaging portions cannot be gripped by an infant's hand.

Since in this embodiment the distance between the same mutually opposite packaging portions in the removal position is smaller than in the securing position, seniors or blind people or visually impaired persons can easily recognize in which of the two reversible positions the packaging is located. Advantageously the user friendliness of the packaging is thus further increased.

For example, it can be expedient for a child-resistant packaging if the distance between mutually opposite packaging portions in the securing position is at least 8 cm, preferably at least 10 cm. These securing distances in the securing position between mutually opposite packaging portions which must be compressed to transfer the packaging into the removal position seem to be sufficiently large for infant hands according to the present knowledge of the applicant. Seniors however should be able to grasp these securing distances with the span width of one hand.

Further details, features and advantages of the invention are obtained from the following explanation of exemplary embodiments of the packagings according to the invention for medicinal products shown schematically in the drawings. In the drawings:

FIG. 1 shows in an oblique view from the front a first embodiment of a packaging according to the invention in cushion form, wherein the packaging in the diagram on the packaging top side shows a blister card with blister cavities for receiving packing product, which is protected by a backing card on the packaging underside forming a packaging interior;

FIG. 2A shows in a sectional view from the side the narrow side of a second embodiment of a packaging according to the invention in cushion form, wherein in this packaging a blister card with blister cavities for receiving packing product is arranged on the packaging top side and a backing card without blister cavities is provided on the packaging underside, which backing card rests on the blister card in a securing position of the packaging;

Figure 21:
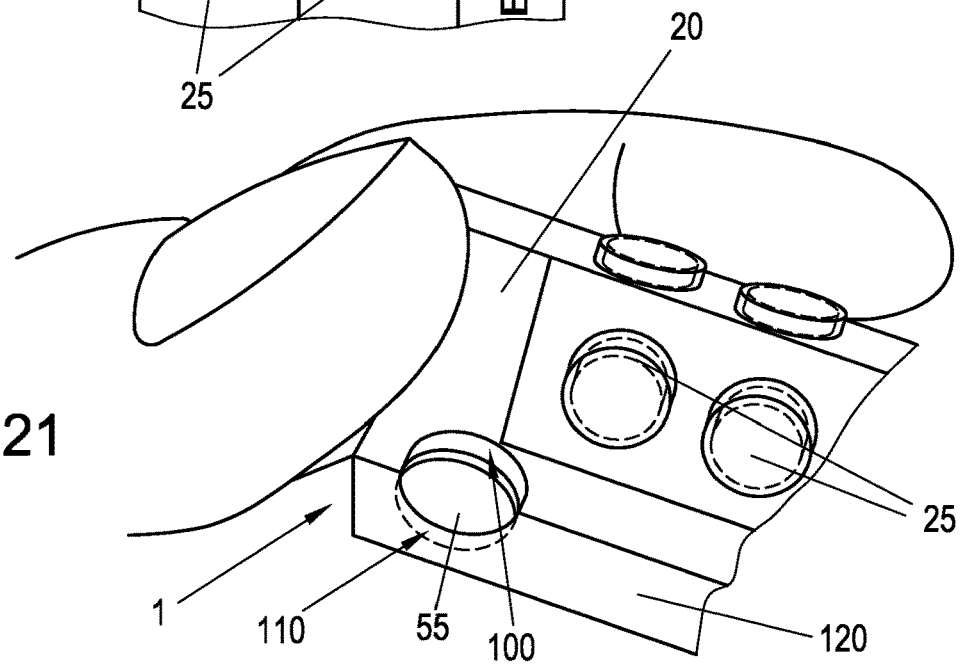
Figure 22:
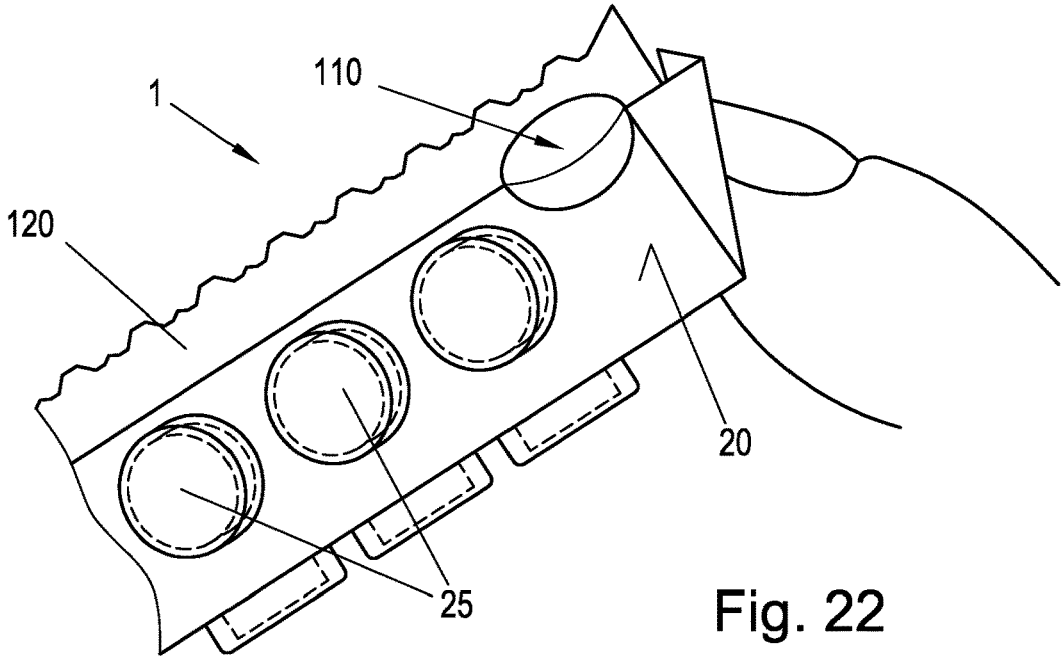
Figure 23:
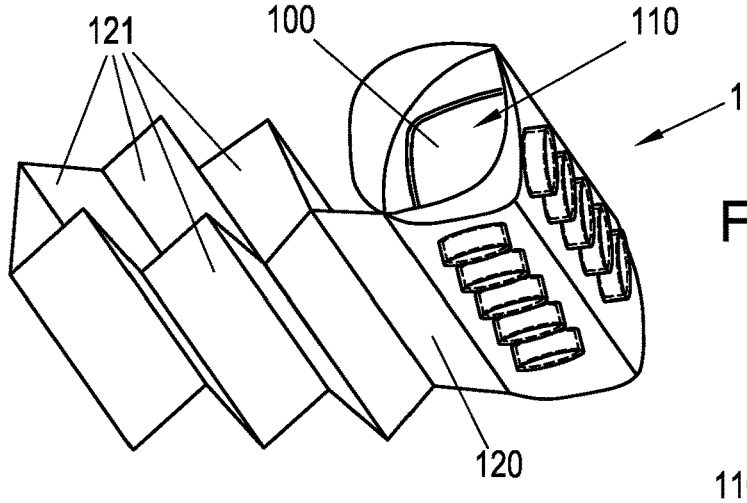
Figure 24:
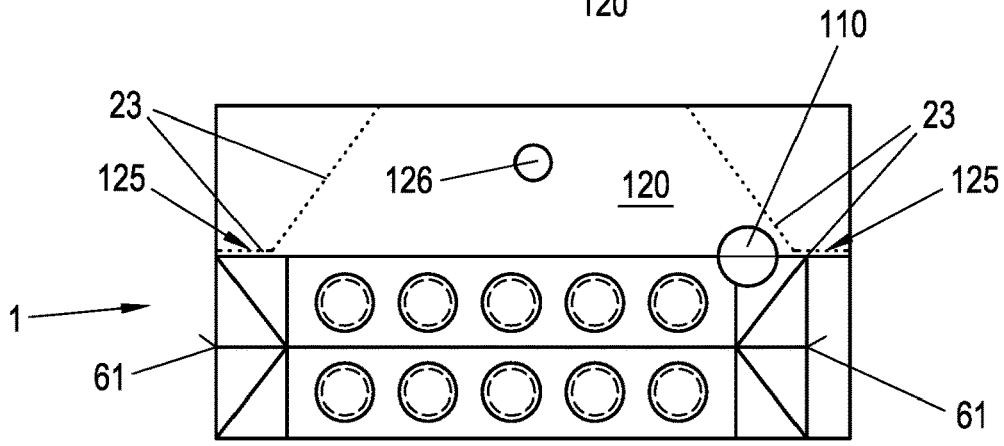
Figure 25:
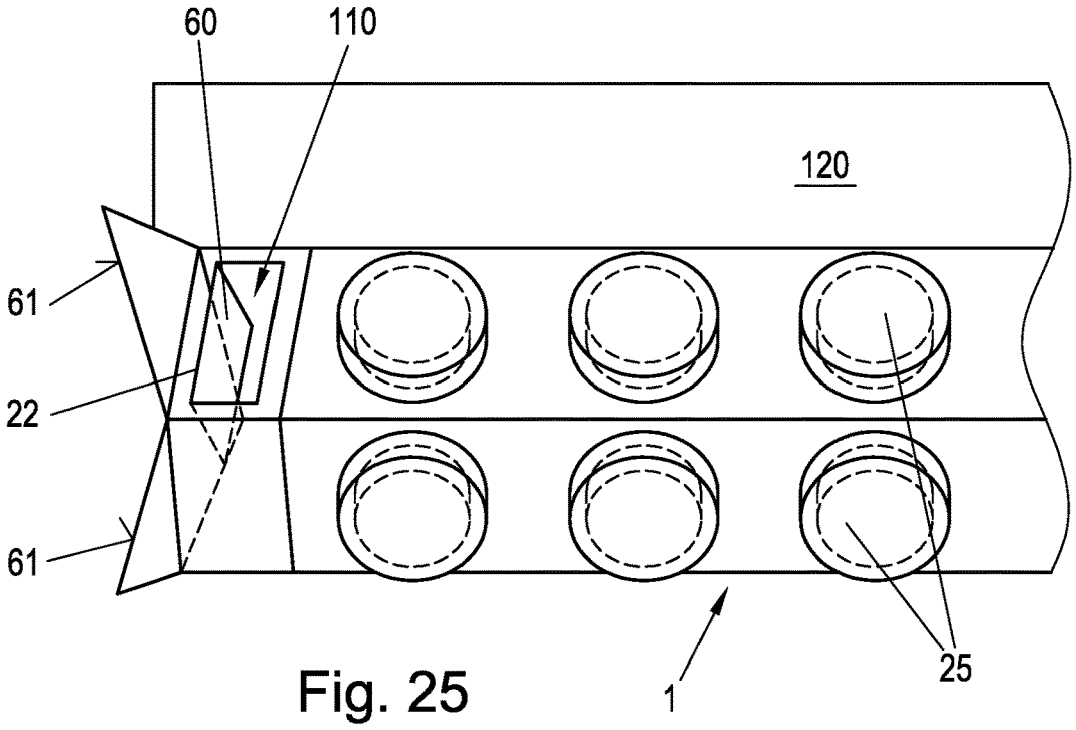

FIG. 21 relates to a detail of a further embodiment of a packaging in cushion form according to the invention shown in oblique view, wherein a removal opening for the packing product is stamped into the carrier film lying at the top here and in which the opposite lower carrier film is deep-drawn;

FIG. 22 shows in an oblique view a detail of a further embodiment of a packaging in cushion form according to the invention which is illustrated here in its removal position and in which a removal opening for the packing product is stamped through both opposite carrier films;

FIG. 23 illustrates in a side view a further embodiment of a packaging in cushion form according to the invention wherein a fold-out package insert is fastened to the inscription tab;

FIG. 24 shows in a front view a further embodiment of a packaging in cushion form according to the invention wherein the packaging is illustrated in its securing position and the inscription tab is provided with a tear-out removal securing;

FIG. 25 shows in a detailed view from the front a further embodiment of a packaging according to the invention in cushion form, wherein the packaging is illustrated in its removal position in the diagram and on the packaging top side a removal opening together with a closure tab for the packing product is stamped into the carrier film lying at the top.

The now-following general description of the figures relates generally to all the figures shown. In the following the same reference numbers are used in each case for the same or comparable elements of the packaging for the different embodiments.

FIGS. 1 to 7 each show different embodiments of cushion-shaped packagings 1 in each case, which each have two outer surfaces 2 or outer sides 2 of the packaging 1 which are interconnected along the long sides 3 of the packaging 1. Closure tabs are arranged on the opposite narrow sides 4 and the opposite narrow sides 4 are characterized as mutually opposite packaging portions, namely as first packaging portion 5 as well as second packaging portion 6 opposite to this, wherein these packaging portions 5, 6 must be compressed by hand in order to transfer the packaging 1 from a securing position 70 into a removal position 80.

Depending on the design and application of the packaging, the packaging portions 5 and 6 can be marked directly and characterized as actuating portions. Alternatively to this, these packaging portions 5 and 6 can also only be characterized in separately enclosed usage instructions for using the packaging, with the result that the child-resistant design of such a packaging is further increased. Naturally the packaging portions 5 and 6 can be characterized both directly on the packaging and also in usage instructions.

The cushion-shaped packaging 1 comprises in each case a blister card 10 with a top side 11 and an underside 12. As already noted initially, the designations of a top side 11 and an underside 12 of the blister card 10 opposite the top side 11 selected hereinafter merely serve to simplify and refine the assignment of the relevant sides. The blister card 10 is arranged in relation to the packaging 1 so that the top side 11 thereof forms an outer side 11 of the blister card 10 or an outer surface 2 of the packaging 1. Conversely the underside 12 of the blister card 10 forms an inner side of the packaging 1.

Figure 1:
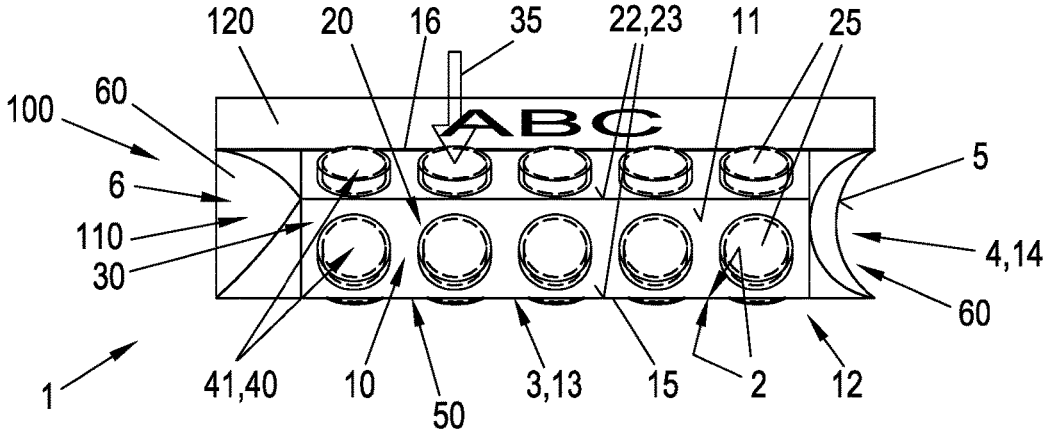

The blister card 10 shown in FIG. 1 is here configured to be substantially rectangular and has a long side 13 and a narrow side 14. The blister card 10 comprises a carrier film 20 which is arranged in FIG. 1 on the top side 11 or the outer side 11 of the blister card 10 and thus also forms an outer surface 1 of the packaging 1. The carrier film 20 is produced, for example, from transparent plastic and has a film thickness 21, for example, of about 200 μm (micron). The carrier film 20 has fold edges 22 and/or perforations 23 or weakening lines 23 in order to be folded, folded or bent along these defined edges or weakening lines. The carrier film 20 has blister cavities 25 for receiving packing product 40. In the packaging 1 illustrated in FIG. 1, for example, a total of ten blister cavities 25 for receiving packing product 40 are arranged on the blister card 10 in two parallel rows of respectively five blister cavities 25. The packing product 40 is illustrated here for simplicity as single tablets 41 in each case.

A cover film 30, for example, made of aluminium is attached to the underside 12 of the blister card 10, wherein the cover film 30 has an exemplary film thickness 31 of about 20 μm (micron). The cover film 30 is connected at least in sections extensively to the carrier film 20 leaving the blister cavities 25 free. For example, the cover film 30 is connected to the carrier film 20 by sealing or by adhesive bonding. The push-through direction 35 of the cover film 30 is characterized by an arrow 35, in order to remove the tablets 41 located therein through the cover film 30 from the blister card 10 by pushing in the direction of the arrow 35 from above or from outside onto the blister cavities 25 of the carrier film 20. The cover film 30 is destroyed in so doing.

In order to prevent the packing product 40 or the tablets 41 from being able to be removed from the blister card 10 unintentionally or unauthorized, for example, by infants, according to the invention on two opposite side edges 15, 16 of the blister card 10 a backing card 50 for protecting the cover film 30 of the blister card 10 is fastened movably thereon. In the embodiments shown in FIGS. 1 to 7 the first side edge 15 here is a first long side edge 15 of the blister card 10. Likewise the second side edge 16 is a second long side edge 16 of the blister card 10. Closure tabs 60 are arranged in each case on the narrow sides 4 of the packaging 1.

Figure 2A:
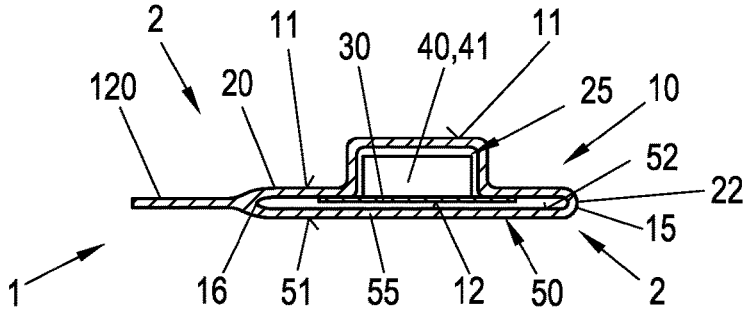
FIG. 2B shows in a sectional view from the side the narrow side of the structure of this packaging with a blister card illustrated in FIG. 1, wherein in this packaging a blister card with blister cavities for receiving packing product is arranged on the packaging top side and a further blister card is provided as backing card.

FIG. 2A shows a packaging 1 according to the invention in cushion form, wherein in this packaging a blister card 10 with a row of blister cavities 25 for receiving tablets 41 is arranged on the packaging top and a backing card 50 without blister cavities is provided on the packaging underside. In a securing position 70 of the packaging 1 the backing card 50 rests on the underside 12 of the blister card 10 on the cover film 30 attached there. In the securing position 70 the backing card 50 thus serves as a cover card for protecting the sensitive cover film 30 on the underside 12 of the blister card 10. The backing card 50 is here fabricated from a carrier film 55 which is fabricated from the same material as the carrier film 20 of the blister card 10 and is connected to this carrier film 20 along the first long side edge 15 and along the second long side edge 16. The backing card 50 has a top 51 or outer side 51 which forms an outer surface 2 of the packaging 1. The backing card 50 has an underside 52 opposite the top 51 which forms an inner side 52 of the packaging.

Within the scope of the invention it is also provided that for example, the backing card 50 is made from a section of the carrier film 20 of the blister card 10 and thus the carrier films of the blister card 10 and the backing card 50 are integrally connected to one another. That portion of the carrier films which forms the backing card 50 for protecting the cover film 30 of the blister card 10 can, for example, be folded over at a side edge 15 of the blister card 10 to form a fold edge 22 and can be adhesively bonded or heat-sealed to the carrier film 20 thereof on the opposite side edge 16 of the blister card 10.

Figure 2B:
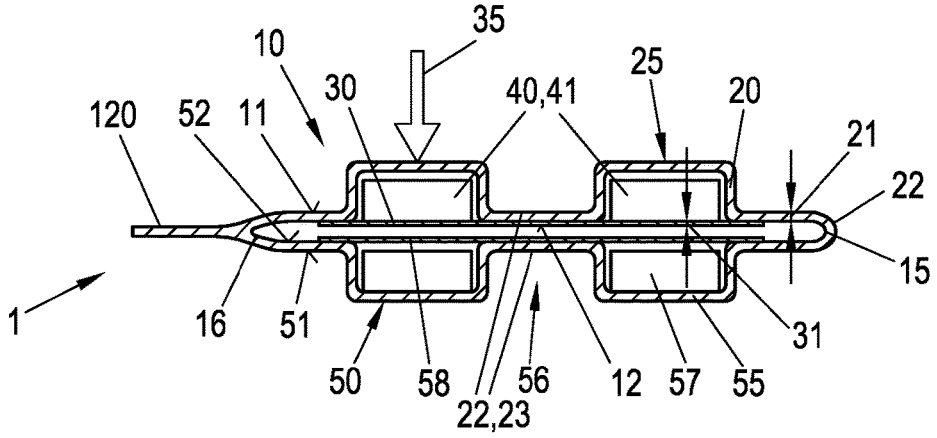

FIG. 2B shows in a side view the narrow side 4 of the structure of this packaging 1 illustrated in FIG. 1 wherein a blister card 10 with blister cavities 25 for receiving tablets 41 is arranged on the packaging top side and a further blister card 56 is provided as backing card 50 on the packaging underside.

In this further blister card 56 blister cavities 57 for receiving tablets 41 are also arranged in two parallel rows next to one another. The blister card 56 comprises a carrier film 55 which is here connected integrally to the carrier film 20 of the blister card 10. Along the first long side edge 15 of the packaging 1, the carrier films 20 and 55 are folded over at a lateral distance from the cover films 30 and 58 to form fold edges 22. In the area of the opposite second long side edge 16, the two carrier films 20 and 55 are heat-sealed together to form an inscription tab 120. The carrier films 20 and 55 here for example are made of a translucent, transparent plastic. The cover films 30 and 58 are made, for example, of an aluminium composite film. As a result of the mirror-inverted arrangement of the two blister cards 10 and 56—the sensitive cover films 30 and 58 lie oriented towards one another protected inside the packaging—the further blister card 56 with the carrier film 55 lying on the outer side thus serves as a cover card for protecting the sensitive cover film 30 on the underside 12 of the blister card 10 and for protecting its own cover film 58. The carrier film 20 has fold edges 22 and/or perforations 23 or weakening lines 23 in order to be able to be folded, folded or bent along these defined edges or weakening lines.

Figure 3:
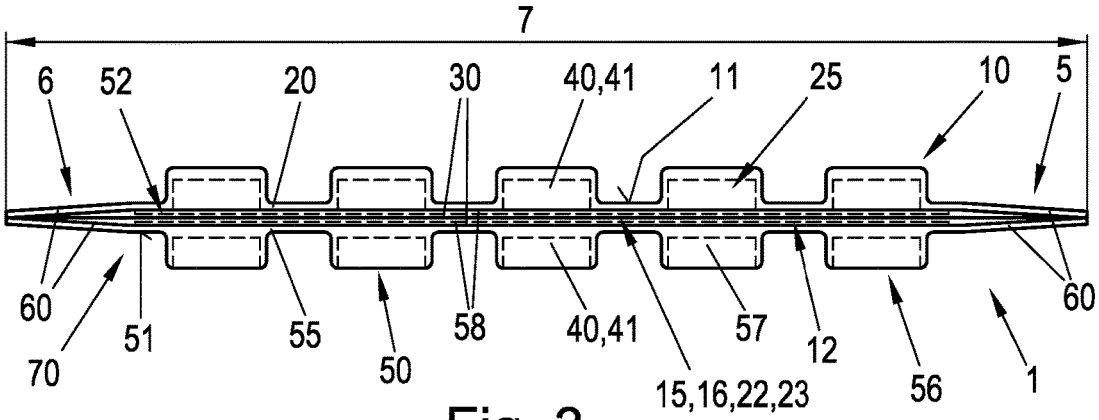
FIG. 3 shows in a sectional view from the side the long side of the embodiment of a packaging according to the invention in cushion form illustrated in FIG. 1 or in FIG. 2B wherein in this diagram the packaging is located in its securing position.

FIG. 3 shows the long side 3 of the embodiment of the packaging 1 in cushion form according to the invention illustrated in FIG. 1 or in FIG. 2B, wherein the packaging 1 is located in its securing position 70 in this diagram. The cover film 58 of the further blister card 56 which serves here as backing card 50 rests on the opposite cover film 30 of the blister card 10. In this second position 70 it is not possible to push through the blister cavities 25, 57 in the push-through direction 35 from outside. The two mutually opposite packaging portions 5 and 6 on the opposite narrow sides 4 of the packaging 1 are located in the flat securing position 70 of the packaging 1 at a maximum distance from one another at a distance 7.

Figure 4:
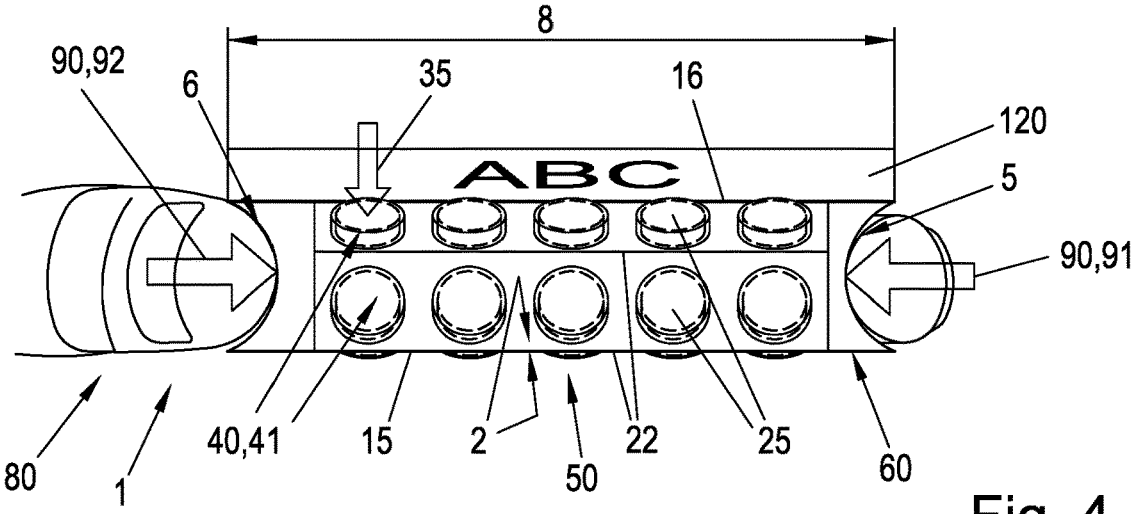
FIG. 4 shows in an oblique view from the front the packaging in cushion form illustrated in FIG. 2B or in FIG. 3, wherein in this diagram the packaging is located in its removal position fixed by compressing.

FIG. 4 shows the packaging 1 in cushion form illustrated in FIG. 2B or in FIG. 3, wherein in this diagram the packaging 1 is located in its removal position 80 fixed by compressing by hand in the direction of the arrow 90. The external application of force 90 by mirror-inverted compression is symbolized by the two opposite arrows 91 and 92 which are intended to illustrate the directions of pressing, for example, by thumb and index finger of one hand of the user of the packaging 1. Compared to the distance 7 in the securing position 70 shown in FIG. 3, here in FIG. 4 the distance 8 between the two opposite packaging portions 7 and 8 in the removal position 80 is significantly reduced or shortened. The two packaging portions 7 and 8 which must be compressed in the cushion packagings shown here are the lateral closure tabs 60 in each case. As a result of the external application of force 90, the cushion-shaped packaging 1 bulges out to form a packaging interior 100. This has the result that during compression 90 of the closure tabs 60 from outside, as long as the packaging 1 is therefore fixed with one hand in its removal position 80, the blister card 10 and the backing card 50 or here the further blister card 56 do not rest on one another at their undersides or inner sides 12 and 52 and therefore the tablets 41 can be removed from the blister cavities 25, 57 by pushing through 35 the blister cards or blister strips with the other free hand.

Figure 5:
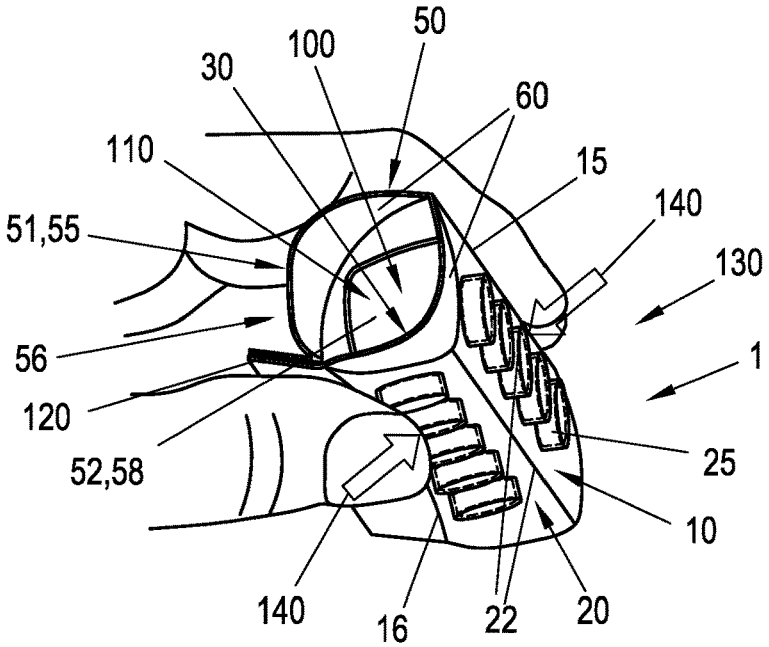
FIG. 5 shows in an oblique view from the top the packaging interior of the packaging illustrated in FIG. 4, wherein in this diagram the packaging is located in its emptying position fixed by compressing.

FIG. 5 shows in an oblique view from above the packaging interior 100 of the packaging 1 illustrated in FIG. 4, wherein in this diagram the packaging is located in its emptying position 130 fixed by lateral compression. A tablet 41 which had already been removed from the blister cards in the removal position 80 and pushed through into the packaging interior 100, can be removed from the packaging 1 after gripping and opening the lateral closure tabs 60 in the emptying position 130. For fixing the packaging 1 in this emptying position 130 the packaging must be compressed on its long side edges 15, 16 in the pushing direction 140 symbolized by two opposite arrows 140.

The opened closure tabs 60 here form an approximately oval removal opening 110 for the packing product 40. Practically tablets 41 can thus be emptied from the packaging interior 100 in a contact-free manner into the mouth of the user.

Figure 6:
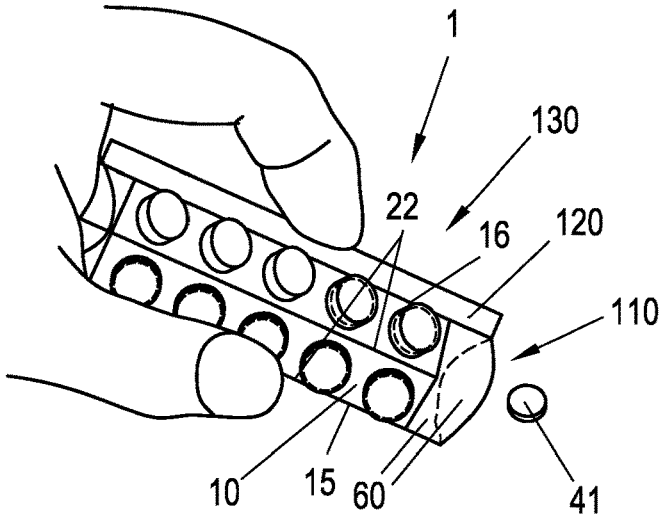
FIG. 6 shows in an oblique view from above the packaging illustrated in FIG. 4 and FIG. 5 after emptying a tablet as dose unit of the packing product from the packaging interior.

FIG. 6 shows the packaging 1 after emptying a tablet 41 as dose unit of the packing product from the packaging interior 100.

Figure 7:
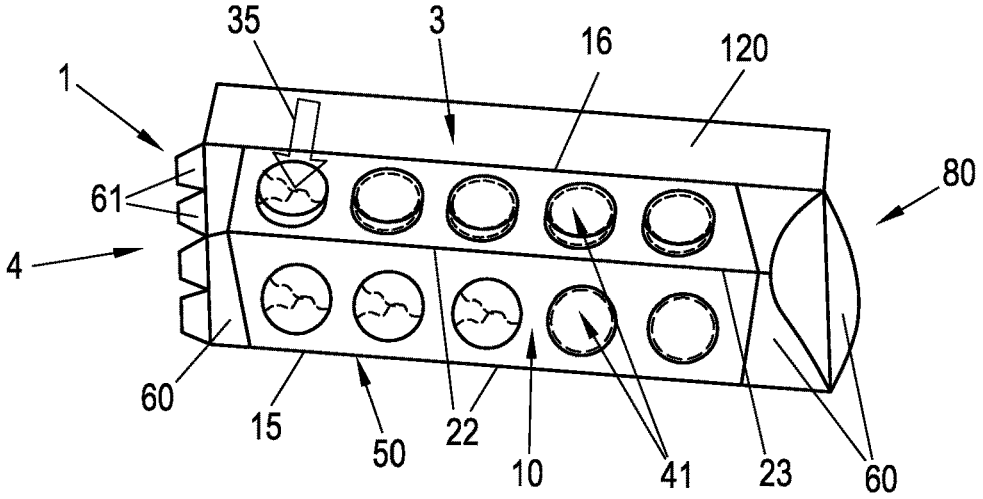
FIG. 7 shows in an oblique view from above a further embodiment of a packaging according to the invention in cushion form, wherein here the closure tabs on the left narrow side of the packaging are heat-sealed to one another.

FIG. 7 shows a further embodiment of a packaging 1 in cushion form according to the invention wherein here the closure tabs 60 on the left narrow side 4 of the packaging 1 are heat-sealed together in sections 61. Thus, only the closure tabs 60 on the right narrow side 4 of the packaging are available as removal opening 110 for the tablets 41 after opening.

FIGS. 8 to 11 show a further embodiment of a packaging 1 according to the invention in which on the packaging underside, a backing card 50 is fastened movably in a foldable manner by means of connecting tabs 65 in the form of a plurality of connecting webs arranged in series on two opposite peripheral portions 17 and 18 of the blister card 10.

Figure 8:
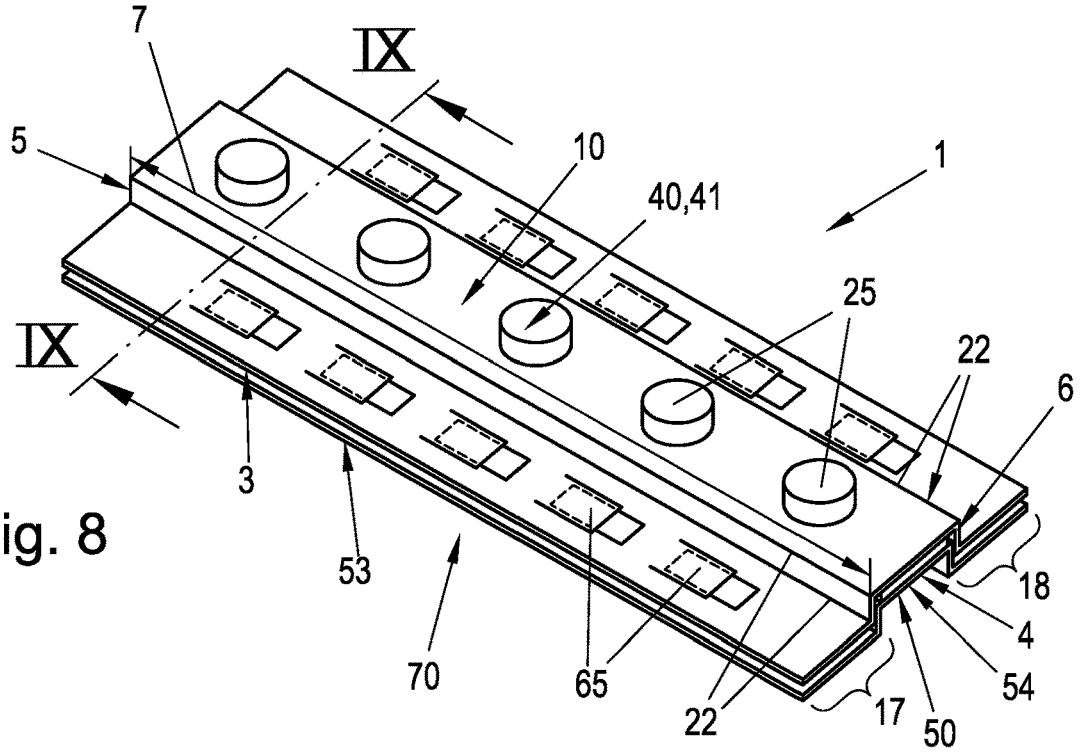
FIG. 8 shows in an oblique view from above a further embodiment of a packaging according to the invention in which on the packaging underside a backing card is fastened movably on two opposite peripheral portions of the blister card by means of connecting tabs in the form of several serially arranged connecting webs.
Figure 11:
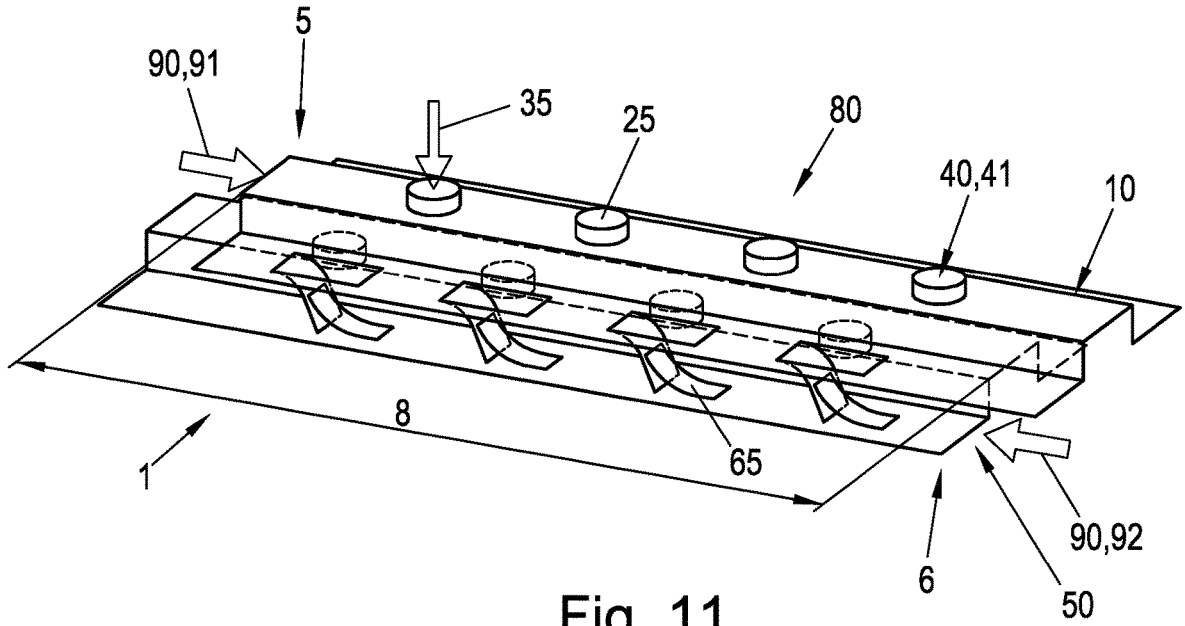
FIG. 11 shows in an oblique view the long side of the packaging illustrated in FIGS. 8 to 10 in its compressed removal position.

FIG. 8 shows this packaging 1 in its securing position 70. Both the blister card 10 and also the backing card 50 which here is a further blister card 56, each have a first peripheral portion 17 along the long side edges thereof and opposite a second peripheral portion 18, wherein several connecting tabs 65 are fastened in these peripheral portions 17 and 18 between the blister card 10 and the backing card 50. Depending on the length of these connecting tabs 65 or connecting webs, the two interconnected elements, i.e. the blister card 10 and the backing card 50 can be transferred from their securing position 70 into their removal position 80, which is illustrated in FIG. 11, by lateral compression on the first packaging portion 5 and on the second packaging portion 6. The blister card 10 and the backing card 50 are each formed in the shape of U-profiles, wherein fold edges 22 running parallel to one another in the longitudinal direction of the packaging 1 serve to increase the stiffness of the blister card 10 or the backing card 50.

Figure 9:
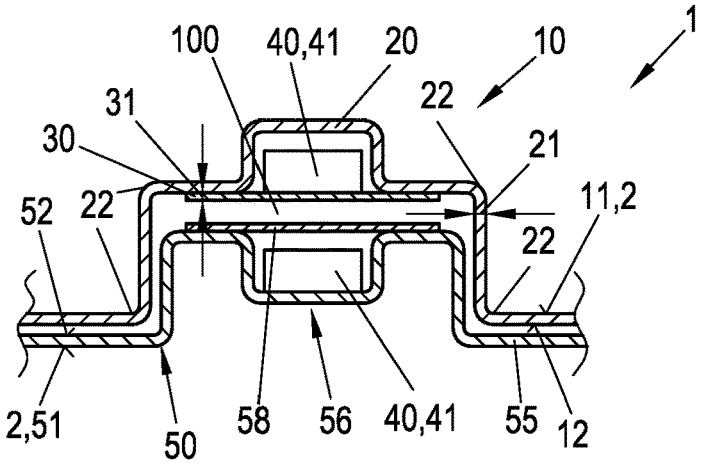
FIG. 9 shows in a sectional view according to the line of intersection IX-IX sketched in FIG. 8 from the side a detail of the packaging illustrated in FIG. 8.

FIG. 9 shows in a sectional view according to the line of intersection IX-IX sketched in FIG. 8 from the side a detail of the packaging 1 illustrated in FIG. 8. The cover films 30 and 58 of the blister card 10 or the further blister card 56 in their function as backing card 50 for the blister card 10 at the top in the diagram rest directly on one another in the securing position 70. In the purely schematic FIG. 9 an apparent air space or distance between the blister card 10 and the backing card 50 is shown merely for clearer representation. As soon as an attempt is made in this securing position 70 to remove tablets 41 from the packaging 1 from outside by pushing through 35 the blister cavities 25 or 57, the two cover films 30 and 58 rest on one another in each case and alternately and mutually stabilize or protect one another before these can be pushed through. That state applies synonymously also to the diagrams in FIGS. 2A, 2B, 12 and 16 where in each case to better represent the packaging function in its securing position 70, layers of the blister cards 10 resting on one another and backing cards 50 assigned to these are illustrated apparently with an interposed spacing. As stated, this merely serves for simpler representation and assignment of individual layers to the respective elements of the packaging.

Figure 10:
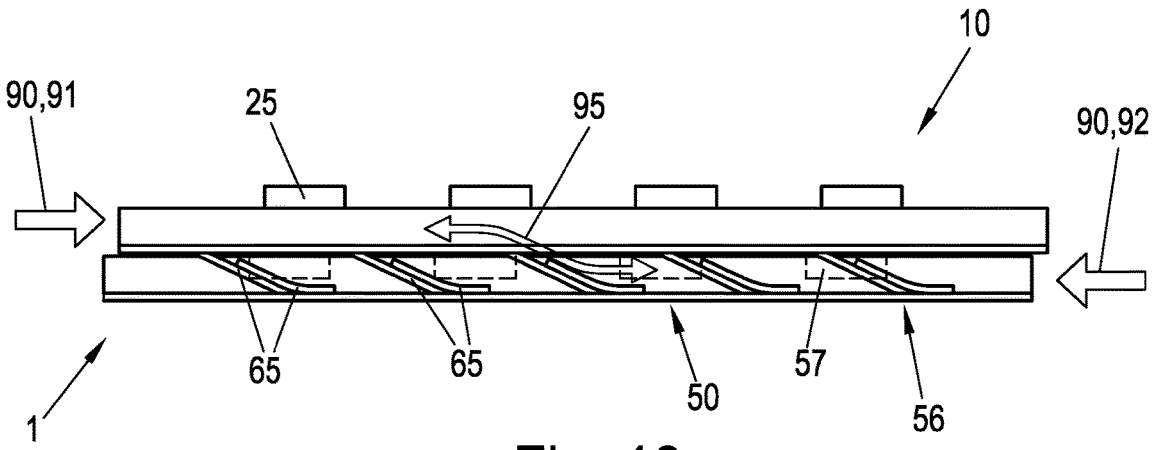
FIG. 10 shows in an oblique view the long side of the packaging illustrated in FIG. 8 and FIG. 9 during transfer from the securing position into the removal position of the packaging.

FIG. 10 shows the long side of the packaging 1 illustrated in FIG. 8 and FIG. 9 during transfer from the securing position 70 into the removal position 80 of the packaging 1.

The direction of movement 95 which is brought about by external application of force 90 by mirror-inverted compression or displacement 91, 92 by means of two fingers of a hand of the user is symbolized by the double arrow 95.

FIG. 11 shows the long side of the packaging 1 illustrated in FIGS. 8 to 10 in their compressed removal position 80. The upper blister card 10 is here located at a distance from the backing card 50 forming a packaging interior 100.

FIGS. 12 to 15 relate to a further embodiment of a packaging 1 according to the invention in the form of a hexagonal straight prism.

Figure 12:
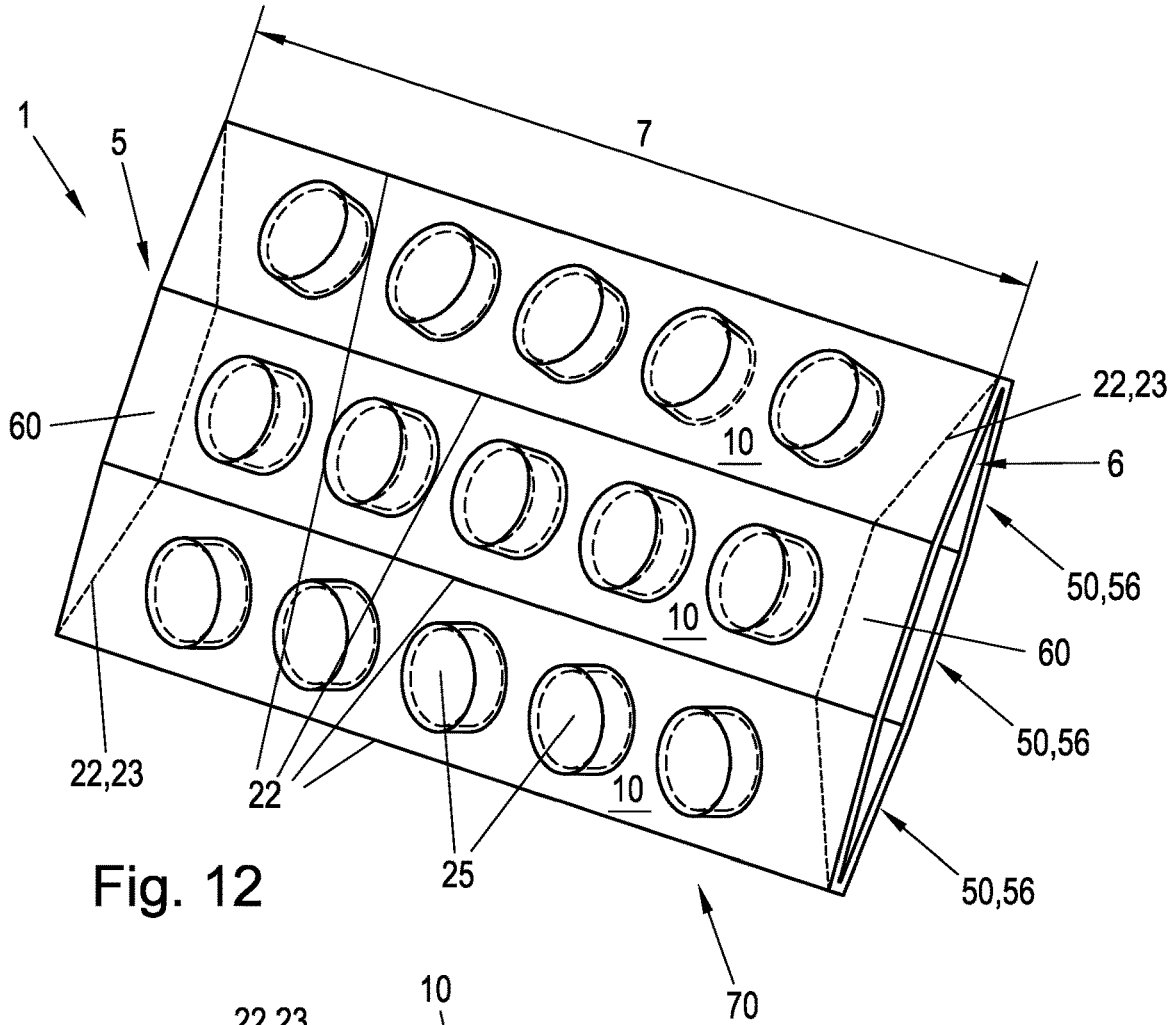
FIG. 12 shows in an oblique view from above a further embodiment of a packaging according to the invention in the form of a hexagonal straight prism in a spread-out-flat securing position.

FIG. 12 shows this packaging 1 according to the invention in the form of a hexagonal straight prism in a spread-out-flat securing position 70. In order to increase the movability of the blister cards 10 and/or backing cards 50, 56 arranged next to one another in a strip-like manner, the long side edges are executed as fold edges 22. Alternatively or in addition to the fold edges 22, perforations 23 or weakening lines 23 can also be provided for weakening the material of the carrier films 20, 55.

Figure 13:
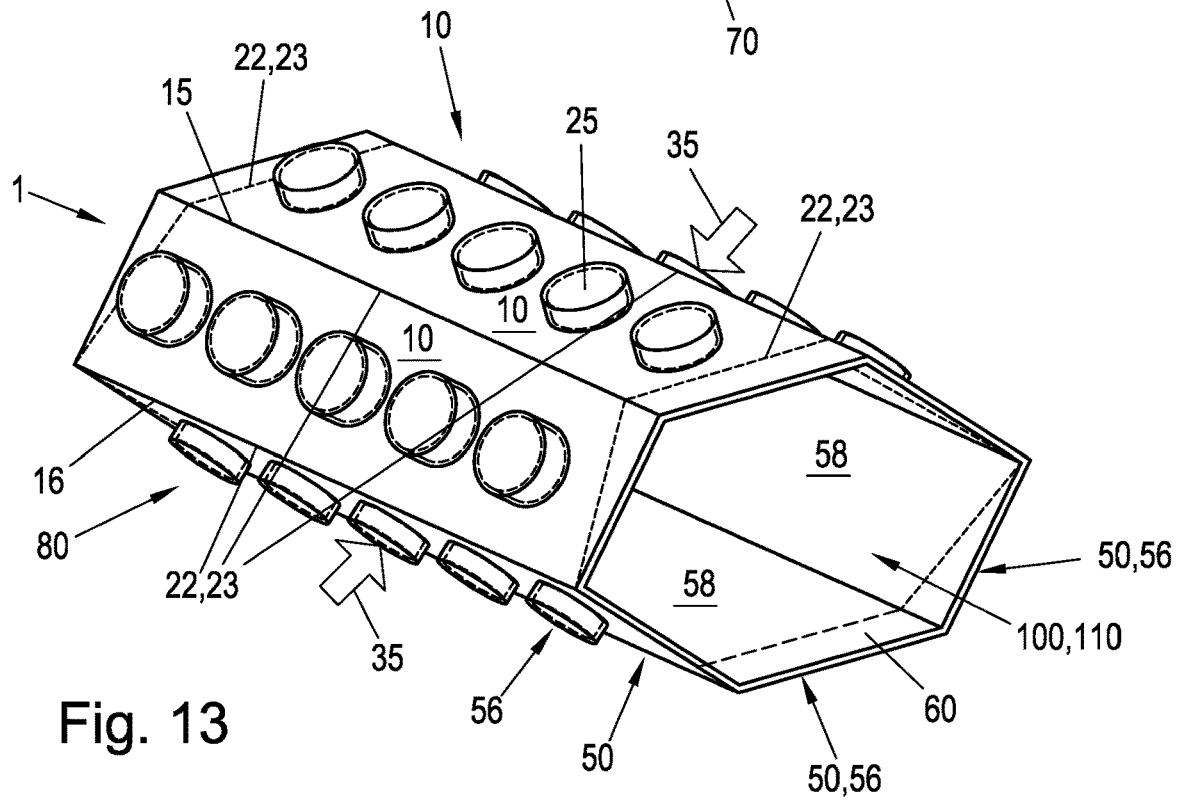
FIG. 13 shows in an oblique view from the side the packaging illustrated in FIG. 12 in its compressed removal position wherein the view into the packaging interior of the prism-shaped packaging is exposed.

FIG. 13 shows this packaging 1 in its compressed removal position, wherein the view into the packaging interior 100 of the prism-shaped packaging 1 is exposed.

Figure 14:
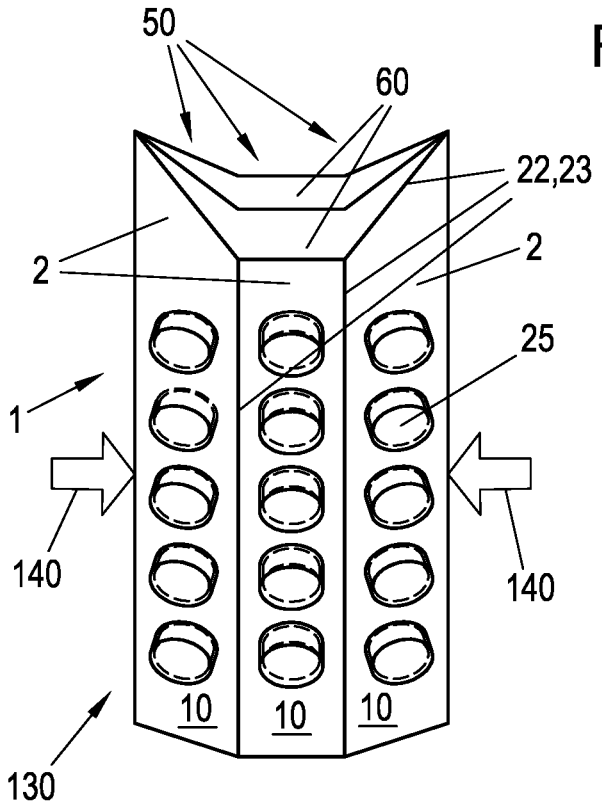
FIG. 14 shows in an oblique view from above the packaging illustrated in FIG. 13 with the closure tabs turned down on the narrow sides of the packaging.

FIG. 14 shows this packaging 1 with closure tabs 60 bent over on the narrow sides of the packaging 1. For fixing the packaging 1 in this emptying position 130, the packaging must be compressed on its long side edges 15, 16 in the pressure direction 140 symbolized by two opposite arrows 140.

Figure 15:
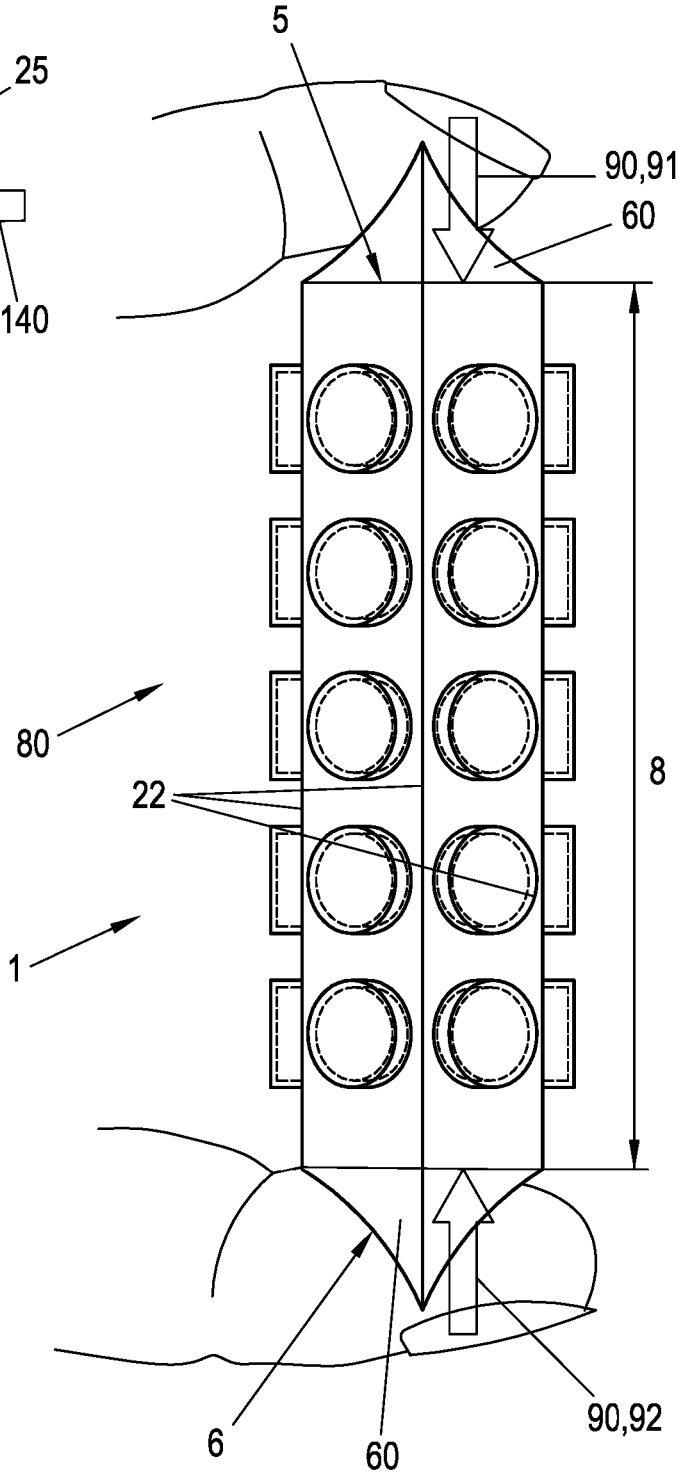
FIG. 15 shows in a side view the packaging illustrated in FIGS. 12 to 14 in its compressed removal position.

FIG. 15 shows in a side view the packaging illustrated in FIGS. 12 to 14 in its compressed removal position 80.

Figure 16:
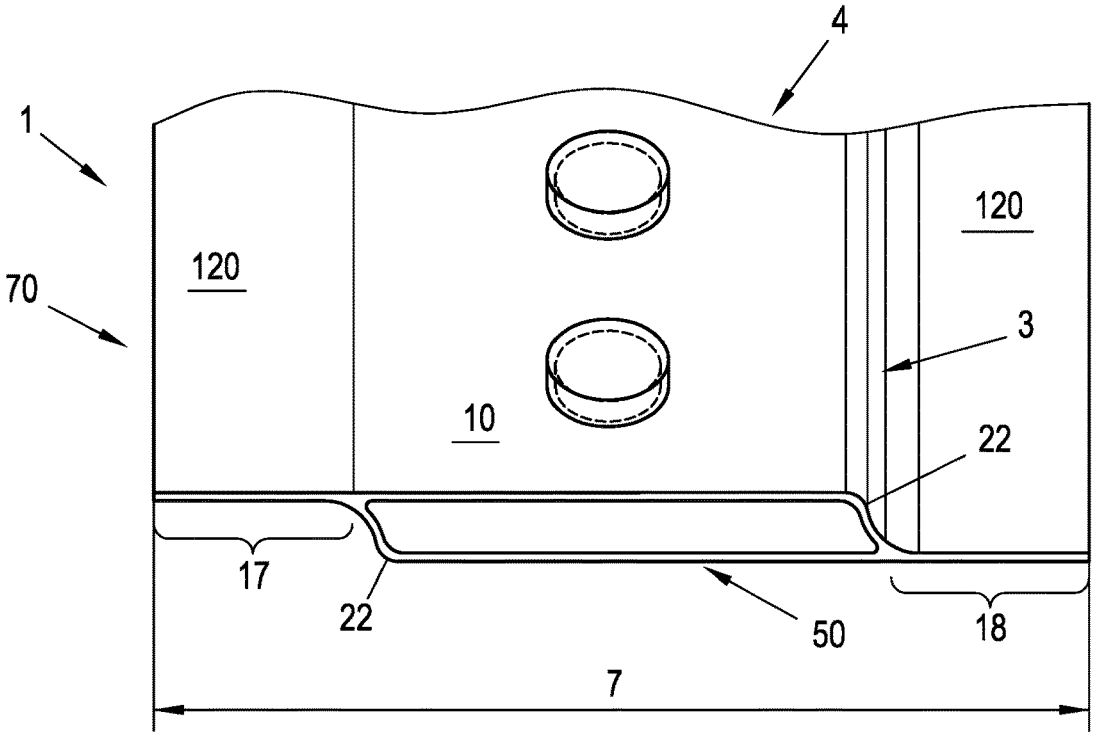
FIG. 16 shows in an oblique view from the side a detail of a further embodiment of a packaging according to the invention in the form of two blister cards which in their securing position lie congruently one above the other in a mirror-inverted manner and which are connected along their two long side edges to inscription tabs which form peripheral portions of the blister cards.
Figure 17:
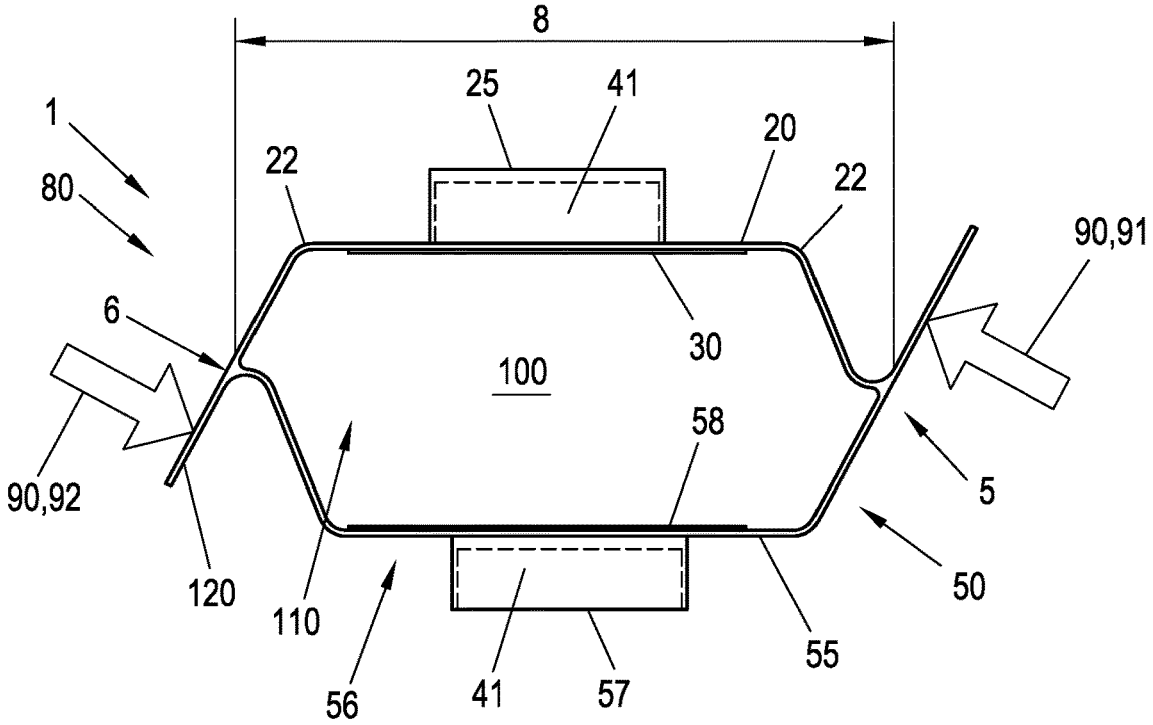
FIG. 17 shows in a side view the narrow sides of the packaging illustrated in FIG. 16 in its compressed removal position.

The two FIGS. 16 and 17 relate to a further embodiment of a packaging 1 according to the invention in the form of a blister card 10 and a backing card 50 which is also executed as a further blister card 56. The two blister cards 10 and 56 in their securing position 70 lie congruently in a mirror-inverted manner above one another and are connected along their two long side edges 15, 16 to inscription tabs 120 which form the peripheral portions 17, 18 of the blister cards 10 and 56.

FIG. 16 shows this packaging 1 according to the invention in its securing position 70.

FIG. 17 shows in a side view the narrow side of the packaging illustrated in FIG. 16 in its compressed removal position 80. Advantageously for this purpose the two inscription tabs 120 can be roughened, for example, so that these can be gripped more easily for the user and compressed. At the same time, these inscription tabs 120 can be constituted by means of corresponding design measures such as, for example, comparatively sharp outer long edges so that these are perceived to be unpleasant when touched by infants. As a result, infants are additionally deterred from compressing the packaging 1 by compressing the inscription tabs 120 which are unpleasant to touch.

The packagings 1 shown here each comprise blister cards 10 or backing cards 50 which have substantially rectangular contours. However, the invention is not restricted to rectangular or strip-shaped blister cards 10 or backing cards 50 but naturally, for example, square, circular or elliptical blister cards 10 or backing cards 50 can also be used for a packaging 1 according to the invention.

Figure 18:
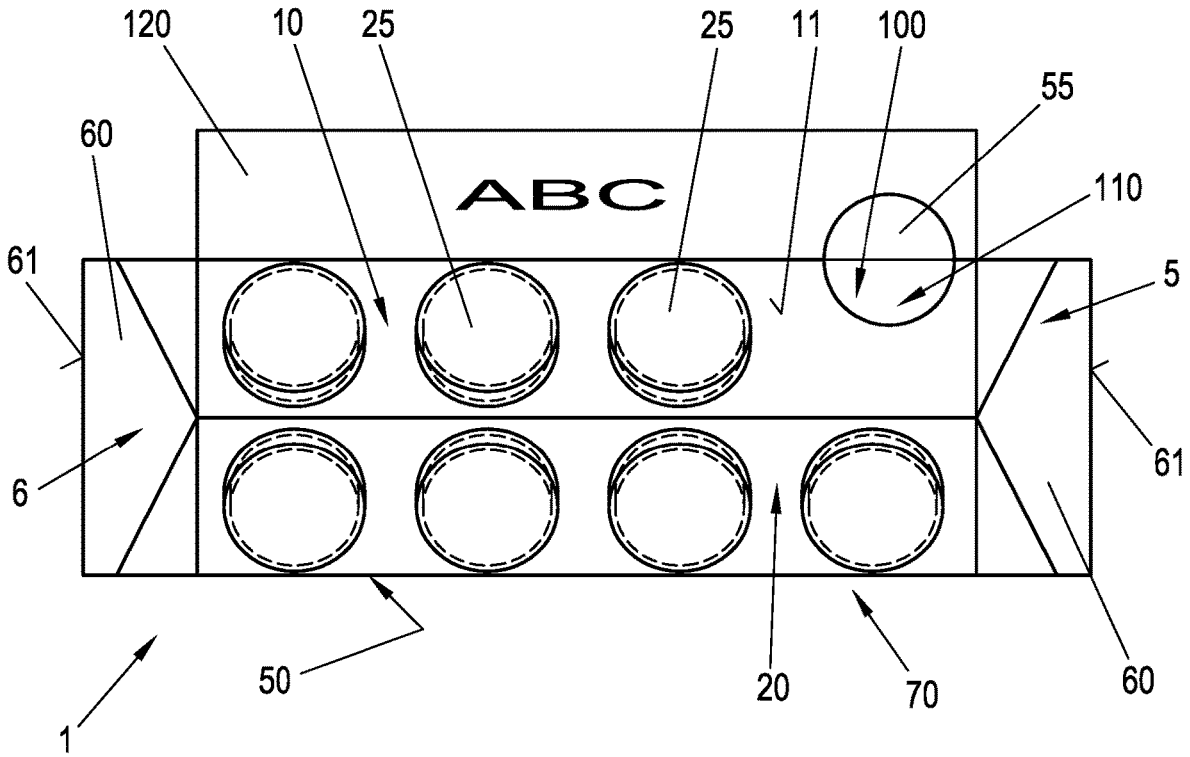
FIG. 18 shows in a front view a further embodiment of a packaging according to the invention in cushion form, wherein the packaging is illustrated in its securing position and on the top side of the packaging a removal opening for the packing product is stamped into the carrier film lying at the top here.

The further FIGS. 18 to 25 are explained in detail in the following:

FIG. 18 shows a further embodiment of a packaging 1 according to the invention in cushion form, wherein the packaging 1 is illustrated here in its securing position 70. On the top side of the packaging 1 or on the top side 11 of the blister card 10, a removal opening 110 for the packing product is stamped into the carrier film 20 lying at the top here. The backing card 50 which is fastened along two opposite long side edges 15, 16 on the blister card 10 and which in the securing position 70 rests on the underside 12 or on the inner side of the blister card 10, is made from a section of the carrier film 20 of the blister card 10. The carrier films 20, 55 of the blister card 10 and the backing card 50 are connected integrally to one another. The blister card 10 lying at the top in the figure here, for example, comprises two rows of blister cavities 25 for receiving packing product 40. Specifically here, for example, seven tablets 41 are packed in the blister card 41 lying at the top. The removal opening 110 in the carrier film 20 at the top is here stamped out in a circular shape and is arranged on a corresponding section of the carrier film 20 of the blister card 10 before heat-sealing the two carrier films 20 and 55 to form a lateral inscription tab 120. In this embodiment the corresponding opposite section of the carrier film 55 of the backing card 50 is not stamped or deformed. The removal opening 110 is here advantageously positioned so that a section of the stamped-out removal opening 110, for example, about half the cross-section of the circular removal opening 110, is arranged in the region of the lateral inscription tab 120. This has the advantage that thus only approximately the remaining other half of the removal opening 110 is available as free cross-section for removal of packing product 40 and in the securing position 70 of the packaging 1 the removal opening 110 is reliably closed. Lateral closure tabs 60 on the two mutually opposite narrow sides 4 of the packaging 1 are each heat-sealed together along sections 61. The stamped-in removal opening 110 is thus the only opening of the packaging 1 for removal of packing product.

Figure 19:
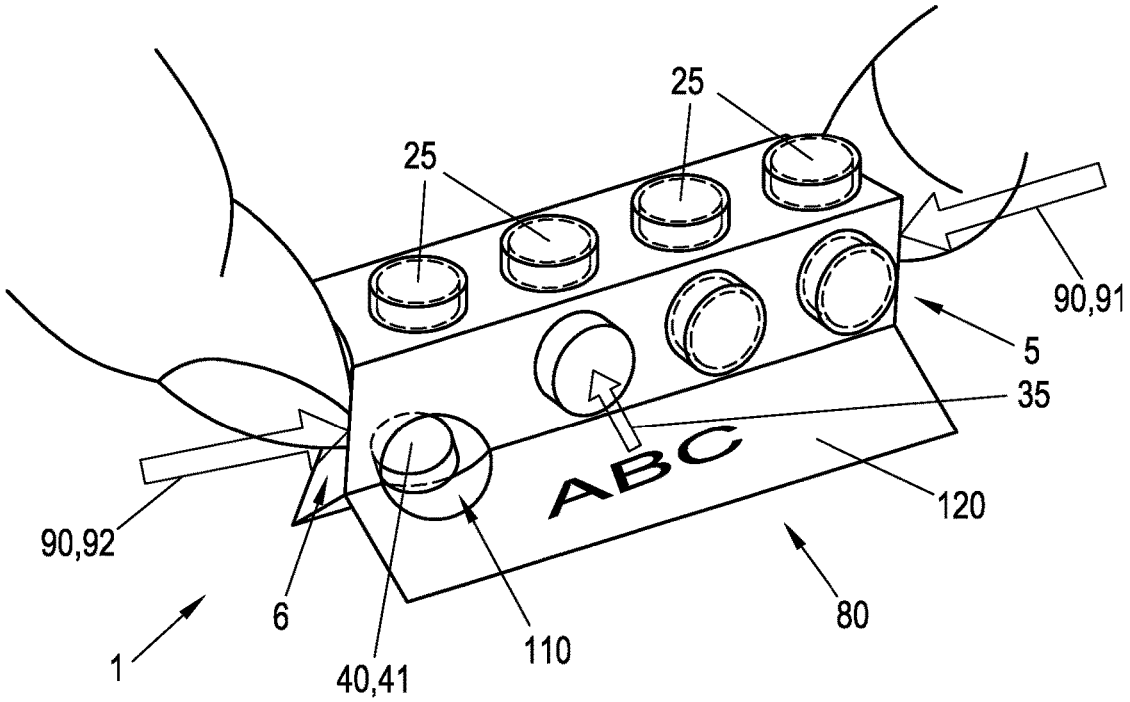
FIG. 19 shows in an oblique view the packaging illustrated in FIG. 18 in its removal position fixed by compressing.

In the removal position 80 of the packaging 1 as illustrated in FIG. 19 the removal opening 110 here in the form approximately of a semicircle adjacent to the inscription tab 120 is opened in the region of the blister card 10. This has the advantage that the removal opening 110 is as small as possible in order to ensure only the removal of a single packed product 40 or a single tablet 41. Depending on the selected film thickness 21 of the carrier film 20, the edge of that half of the stamped-out circular removal opening 110, which is heat-sealed in the region of the inscription tab 120 to the carrier film 55 of the backing card 50, acts as a boundary edge for the removed packing product 40.

Depending on the design, the removal opening 110 stamped into the carrier film 20 can also differ from a circular shape and for example, be formed in the form of a rectangle, a square, an ellipse or a polygonal curved line. Likewise, the proportion of the removal opening 110 which in the heat-sealed position of the finished packaging 1 comes to lie in the region of the inscription tab 120 and therefore is not available as free cross-section for actual removal of the packing product can vary. For example, the removal opening 110 can be entirely arranged on that section of the carrier film 20 of the blister card 10 which does not form the inscription tab 120 but is actually available as a free removal cross-section with the packaging interior 100.

Likewise, it can be expedient to position the removal opening 110 so that only a specific section of the removal opening 110, for example, only a quarter or a third of the area of the stamped removal opening 110, comes to lie in the region of the inscription tab 120 but the remaining free cross-section is available for actual removal of the packing product 40 from the packaging interior 100.

Figure 20:
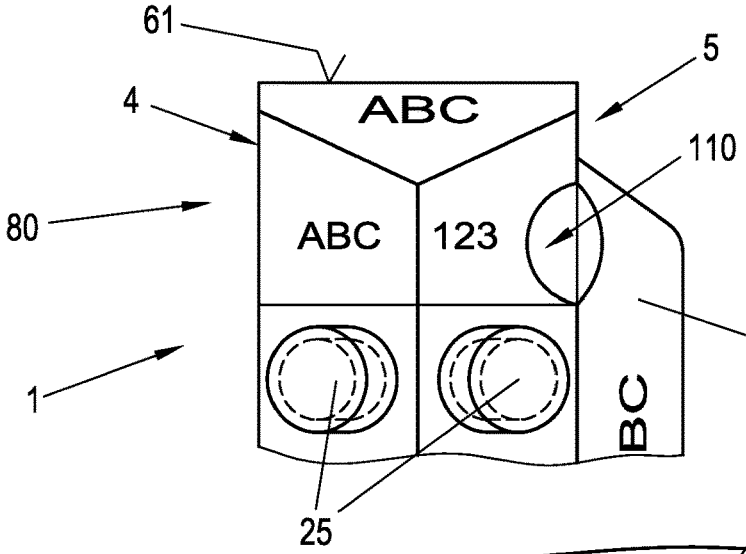
FIG. 20 shows in a detailed view from the front a further embodiment of a packaging according to the invention in cushion form, wherein the packaging is illustrated in its removal position and a removal opening for the packing product is stamped on the top side into the carrier film lying on the top here.

FIG. 20 shows in a detailed view from the front a further embodiment of a packaging 1 according to the invention in cushion form, wherein the packaging 1 is illustrated here in its removal position 80 and on the top side a removal opening 110 for the packing product 40 is stamped into the carrier film 20 of the blister card 10 shown at the top. In this packaging 1 both the inscription tab 120 protruding to the right in the diagram and also the closure tabs 60 on the opposite narrow sides 4 of the packaging 1 are provided with inscriptions. The inscriptions can, for example be printed or glued on the carrier films or on the outer surfaces 2 of the packaging. The lateral closure tabs 60 are heat-sealed together along sections 61. In this embodiment the stamped in removal opening 110 is the only opening for removal of packing product.

FIG. 21 shows a detail of a further embodiment of a packaging 1 according to the invention in cushion form, wherein a removal opening 110 for the packing product 40 is stamped into the carrier film 20 lying at the top here. That section of the opposite lower carrier film 55 of the backing card 50 which corresponds with the removal opening 110 in the carrier film 20 is deep-drawn here and advantageously forms a chute for the packing product 40. With reference to FIG. 18 here also the removal opening 110 is advantageously positioned so that approximately half of the stamped-out removal opening 110 is arranged in the region of the lateral inscription tab 120.

A single packing product 40, for example, a tablet 41 can only be removed individually from the removal opening 110 and thereby enters into the deep-drawn section of the carrier film 55 in the region of the inscription tab 120 which acts like a chute or slide for the individual packing product 40. The edge of the deep-drawn recess of the lower carrier film 55 here acts as a dam for the packing product 40 and prevents the unintentional loss of the removed packing product 40 during removal before this is grasped by the user.

FIG. 22 shows in an oblique view a detail of a further embodiments of a packaging 1 according to the invention in cushion form which is illustrated in its removal position 80. Both mutually opposite carrier films 20, 55 are stamped through here after laminating the inscription tab 110. The removal opening 110 is in this case positioned so that a section of the stamped-out removal opening 110, for example, half of the circular removal opening 110, is arranged in the region of the lateral inscription tab 120. Thus, the removal opening 110 obtained by stamping through both carrier films 20, 55 has the advantage that the free long edge of the inscription tab 120 is also continuous in the area of the removal opening. It is thus ensured that in the removal position 80, in each case only a single packing product 40 or a single tablet 41 can be removed from the packaging 1 through the removal opening 110. The continuous free long edge of the inscription tab 120 here acts as a clamp for that packing product 40 or that tablet 41 located just inside the removal opening 110. Depending on the selected position and the proportion of the removal opening 110 which is positioned in the region of the inscription tab 120 an undesired falling out of packing product 40 from the removal opening 110 can thus be prevented. In order to further increase the safety as child-resistant packaging 1, the continuous free long edge of the inscription tab 120 is here designed to be jagged or roughly structured, for example, which is particularly perceived as unpleasant when grasped by children.

FIG. 23 illustrates in a side view a further embodiment of a packaging 1 according to the invention in cushion form wherein a fold-out package insert 121 is fastened to the inscription tab 120. The package leaflet 121 is here, for example, adhesively bonded in a captive manner to the inscription tab 120 by means of an adhesive film and folded in a pull-out manner like a concertina. FIG. 23 shows the package leaflet 121 in the folded-out position.

FIG. 24 shows in a front view a further embodiment of a packaging 1 in cushion shape according to the invention, wherein the packaging 1 is illustrated in its securing position 70 and the inscription tab 120 is fitted with a tear-off removal securing device 125. The removal securing device 125 serves to ensure that the packaging 1 is secured in its securing position 70 until the removal securing device 125 is removed or opened. As removal securing device 125 the inscription tab 120 has respectively perforations 23 or weakening lines 23 of the carrier films 20, 55 along the long side edge 16 of the blister card 10 and the backing card 50 arranged thereunder, which extend from the mutually opposite narrow sides 4 of the packaging 1 along a section of the long side edge 16. The sections of the perforations 23 or weakening lines 23 along the long side edge 16 must first be torn off before the packaging 1 is transferred into its removal position 80 in the manner already described previously by external application of force 90 by mirror-inverted compression 91, 92 of the two mutually opposite packaging portions 5, 6 and the removal opening 110 stamped into the upper carrier film 20 is thus opened. The lateral closure tabs 60 on the narrow sides 4 are heat-sealed together along sections 61. In this embodiment the stamped-in removal opening 110 is the only opening for removal of packing product.

The two outer wings or sections of the inscription tab 120 can be removed after tearing open the perforations 23 along the long side edge 16 by then further tearing open along weakening lines 23 which, for example run obliquely in the direction of the free long edge of the inscription tab 120. In FIG. 24 the inscription tab 120 here has a hanging opening 126 approximately in its longitudinal centre which is used for hanging the packaging 1 for example on a sales stand.

FIG. 25 illustrates in a detailed view a further embodiment of a packaging 1 according to the invention in cushion form, wherein the packaging 1 is illustrated in its removal position 80 and on the packaging top side a removal opening 110 for the packing product is stamped into the carrier film 20 lying at the top. The removal opening 110 is here advantageously arranged transversely to the longitudinal direction of the packaging and for example, has an approximately rectangular contour. In this variant, the removal opening 110 is only stamped out along three sides maintaining an edge distance from the carrier film 20. The fourth side, preferably a long side of the rectangular contour is not stamped out or stamped through but is merely machined to form a weakening line 23 or a perforation line 23 of the carrier film 20. Alternatively or in addition to the perforation 23 the contour along this fourth side can also be provided with a fold edge 22. Thus, a movable foldable closure tab 60 remains inside the removal opening 110 which remains along one side of the removal opening 110 connected to the adjacent carrier film 20 to form a fold edge 22 and/or a perforation line 23. This foldable closure tab 60 ensures that for the case where the packaging 1 is located in its securing position 70 the removal opening 110 is closed. As soon as the packaging 1 is transferred into its removal position 80 as a result of an external application of force 90 by means of mirror-inverted compression 91, 92 of the two mutually opposite packaging portions 5, 6, the removal opening 110 stamped into the upper carrier film 20 thus opens and the foldable closure tab 60 folds inwards into the packaging interior 100 along the weakening line 23 or perforation 23 and/or the fold line 22 and thus automatically exposes the removal opening 110.

REFERENCE LIST

1 Packaging
2 Outer surface
3 Long side of the packaging
4 Narrow side of the packaging
5 First packaging portion
6 Second packaging portion
7 Distance between the packaging portions in the securing position
8 Distance between the packaging portions in the removal position
10 Blister card
11 Top side or outer side of blister card
12 Underside or inner side of blister card
13 Long side of blister card
14 Narrow side of blister card
15 First side edge (or long side edge) of blister card
16 Second side edge (or long side edge) of blister card
17 First peripheral portion of blister card
18 Second peripheral portion of blister card
20 Carrier film
21 Film thickness of carrier film
22 Fold edge of carrier film
23 Perforation or weakening line of carrier film
25 Blister cavity
30 Cover film
31 Film thickness of cover film
35 Push-through direction of cover film (arrow)
40 Packing product
41 Tablet
50 Backing card
51 Top side or outer side of backing card
52 Underside or inner side of backing card
53 Long side of backing card
54 Narrow side of backing card
55 Carrier film
56 (Further) blister card
57 Blister cavity
58 Cover film
60 Closure tab
61 Heat-sealed section of closure tab
65 Connecting tab, connecting web
70 (First) securing position
80 (Second) removal position
90 Action of external force during removal position (arrow)
91 (First) pushing direction of the mirror-inverted compression (arrow)
92 (Second) pushing direction of the mirror-inverted compression (arrow)
95 Direction of movement between securing and removal position (double arrow)
100 Packaging interior
110 Removal opening for the packing product, packing product removal opening
120 Inscription tab
121 Package leaflet
125 Removal securing device
126 Hanging opening
130 Emptying position
140 Pushing direction during emptying position (arrow)

The invention claimed is:

1. A child-resistant medicinal product packaging, comprising:

at least one blister card (10), wherein the blister card (10) comprises two films, of which one film is configured as a carrier film (20) with at least one blister cavity (25) for receiving packing product (40) and forms a top side (11) of the blister card (10), and the other film is configured as a push-through cover film (30), wherein the cover film (30) at least in sections is connected extensively to the carrier film (20) leaving open the at least one blister cavity (25), and at least in sections forms an underside (12) of the blister card (10) opposite the top side (11) and the cover film (30) closes the at least one blister cavity (25) filled with packing product (40), wherein at least one backing card (50) is fastened in a movable manner at two opposite side edges (15, 16) or at two opposite peripheral portions (17, 18) of the blister card (10) and this backing card (50) in a securing position is configured to rest at least in sections in a planar manner on the underside (12) of the blister card (10) and in so doing to secure the enclosed packing material (40) against unintentional removal and against pushing through (35) of the cover film (30), wherein the backing card (50) is configured to be transferred reversibly from the securing position (70) into a removal position (80) by means of an external force application (90) by mirror-inverted compression (91, 92) of two mutually opposite and spaced apart (7, 8) packaging portions (5, 6) which are movably coupled to one another, wherein the movement transition between the securing position (70) in which no external application of force is made to the spaced-apart (7, 8) packaging portions (5, 6) and the removal position (80) fixed by external application of force (90) is a reversible to-and-fro movement, wherein the carrier film (20) has (i) at least one fold edge (22), (ii) at least one perforation (23) as a weakening line (23), or both (i) and (ii), in order for the carrier film to be folded, flipped or curved along (a) the at least one fold edge (22), (b) the weakening line (23), or both (a) and (b), wherein during the removal position (80) fixed by external application of force (90), the at least one backing card (50) is spaced apart from the underside (12) of the blister card (10) forming a packaging interior (100) having at least one packing product removal opening (110) wherein in the removal position (80) the packing product (40) is configured to be released by pushing through (35) the cover film (30) into the packaging interior (100) and removed from the packaging interior (100) through the at least one packing product removal opening (110), and wherein the side of the packaging interior (100) opposite a packing product removal opening (110) is configured to be closed with a closure tab (60).

2. The packaging of claim 1, wherein the at least one backing card (50) comprises a carrier film (55) or is formed from a carrier film (55).

3. The packaging of claim 1, wherein the at least one blister card (10) and the at least one backing card (50) are each configured in the form of rectangles, wherein the backing card (50) is fastened in each case on two opposite side edges (15, 16) or on two opposite peripheral portions (17, 18) of the long sides (13) of the blister card (10).

4. The packaging of claim 1, wherein the at least one backing card (50) is movably fastened by connecting tabs (65).

5. The packaging of claim 4, wherein the at least one backing card (50) is movably fastened by a plurality of serially arranged connecting webs at two opposite peripheral portions (17, 18) of the blister card (10).

6. The packaging of claim 1, wherein at least one inscription tab (120) is fastened to at least one of the blister card (10) and the backing card (50).

7. The packaging of claim 6, wherein the at least one inscription tab (120) is fastened at a side edge (15, 16) or at a peripheral portion (17, 18) of the blister card (10) and projects over the blister card (10).

8. The packaging of claim 1, wherein the at least one packing product removal opening (110) of the packaging interior (100) is configured to be closed with a closure tab (60).

9. The packaging of claim 1, wherein the at least one backing card (50) is a further blister card (56) with (i) a carrier film (55) with at least one blister cavity (57) for receiving packing product (40) and a cover film (58), wherein the at least one further blister card (56) is arranged so that its carrier film (55) forms an outer surface (2) of the packaging (1) and its cover film (58) is oriented towards the packaging interior (100).

10. The packaging of claim 9, wherein in the securing position (70) the blister cavities (25, 57) filled with packing product (40) of two blister cards (10, 56) resting on one another are arranged congruently above one another.

11. The packaging of claim 9, wherein in the securing position (70) the blister cavities (25, 27) filled with packing product (40) of two blister cards (10, 56) resting on one another are each arranged offset with respect to one another.

12. The packaging of claim 9, wherein the packing product (40) comprises a pharmaceutical active substance formulation.

13. The packaging of claim 12, wherein the pharmaceutical active substance formulation is a tablet (41).

14. The packaging of claim 1, wherein the packaging (1) is configured to be cushion-shaped, wherein the two outer surfaces (2) of the packaging (1) are either formed by a first blister card (1) and a further blister card (56) with packing product (40) filled in blister cavities (25, 57) or alternatively by one blister card (10) and by an opposite backing card (50) without packing product, which are interconnected at two opposite side edges (15, 16) of the blister card (10), wherein the side edges (15, 16) form the long sides (3) of the packaging (1), and mirror-inverted overlapping closure tabs (60) are fastened on the mutually opposite narrow sides (14) of the blister cards (10, 56) in each case.

15. The packaging of claim 1, wherein the packaging (1) is configured as a straight prism with an even number of outer surfaces (2), wherein the outer surfaces (2) are formed by one or more blister cards (10, 56) with packing product (40) filled in blister cavities (25, 57) or alternatively by at least one blister card (56) and by one or more backing cards (50) without packing product which are connected at their opposite side edges (15, 16) arranged next to one another and form the long sides (3) of the packaging (1).

16. The packaging of claim 1, wherein a distance (7) between mutually opposite packaging portions (5, 6) in the securing position (70) is greater than the distance (8) between the same mutually opposite packaging portions (5, 6) in the removal position (80).

17. The packaging of claim 1, wherein the at least one backing card (50) is produced from a section of the carrier film (20) of the blister card (10) and the carrier films (20, 55) of the blister card (10) and the backing card (50) are integrally connected to one another.

18. The packaging of claim 1, wherein the packing product (40) comprises a pharmaceutical active substance formulation.

19. The packaging of claim 18, wherein the pharmaceutical active substance formulation is a tablet (41).

20. A child-resistant medicinal product packaging, comprising:

at least one blister card (10), wherein the blister card (10) comprises two films, of which one film is configured as a carrier film (20) with at least one blister cavity (25) for receiving packing product (40) and forms a top side (11) of the blister card (10), and the other film is configured as a push-through cover film (30), wherein the cover film (30) at least in sections is connected extensively to the carrier film (20) leaving open the at least one blister cavity (25), and at least in sections forms an underside (12) of the blister card (10) opposite the top side (11) and the cover film (30) closes the at least one blister cavity (25) filled with packing product (40), wherein at least one backing card (50) is fastened in a movable manner at two opposite side edges (15, 16) or at two opposite peripheral portions (17, 18) of the blister card (10) and this backing card (50) in a securing position is configured to rest at least in sections in a planar manner on the underside (12) of the blister card (10) and in so doing to secure the enclosed packing material (40) against unintentional removal and against pushing through (35) of the cover film (30), wherein the backing card (50) can be transferred reversibly from the securing position (70) into a removal position (80) by means of an external force application (90) by mirror-inverted compression (91, 92) of two mutually opposite and spaced apart (7, 8) packaging portions (5, 6) which are movably coupled to one another, wherein the movement transition between the securing position (70) in which no external application of force is made to the spaced-apart (7, 8) packaging portions (5, 6) and the removal position (80) fixed by external application of force (90) is a reversible to-and-fro movement, wherein the carrier film (20) has (i) at least one fold edge (22), at least one perforation (23) as a weakening line (23) in order for the carrier film to be folded, flipped or curved along (a) the at least one fold edge (22), (b) the weakening line (23), or both (a) and (b), wherein during the removal position (80) fixed by external application of force (90), the at least one backing card (50) is spaced apart from the underside (12) of the blister card (10) forming a packaging interior (100) having at least one packing product removal opening (110) wherein in the removal position (80) the packing product (40) can be released by pushing through (35) the cover film (30) into the packaging interior (100) and removed from the packaging interior (100) through the at least one packing product removal opening (110), and wherein the at least one packing product removal opening (110) of the packaging interior (100) is configured to be closed with a closure tab (60).

* * * * *